US008813436B2

(12) United States Patent
Donnally et al.

(10) Patent No.: US 8,813,436 B2
(45) Date of Patent: Aug. 26, 2014

(54) PINNED STRUCTURAL CONNECTION USING A PIN AND PLUG ARRANGEMENT

(75) Inventors: Robert B. Donnally, Shanghai (CN); Liu Xi Lin, Shanghai (CN); Guo Hou, Shanghai (CN)

(73) Assignee: National Oilwell Varco, L.P., Houston, TX (US)

( * ) Notice: Subject to any disclaimer, the term of this patent is extended or adjusted under 35 U.S.C. 154(b) by 230 days.

(21) Appl. No.: 13/222,243

(22) Filed: Aug. 31, 2011

(65) Prior Publication Data

US 2012/0066999 A1 Mar. 22, 2012

Related U.S. Application Data

(63) Continuation-in-part of application No. 12/074,258, filed on Feb. 29, 2008, now Pat. No. 8,549,815.

(51) Int. Cl.
*E02C 3/00* (2006.01)
*E04H 12/18* (2006.01)
*E04H 12/10* (2006.01)

(52) U.S. Cl.
CPC ..... *E04H 12/18* (2013.01); *E04H 12/10* (2013.01)
USPC ..... 52/123.1; 52/118; 52/745.1; 52/117; 52/745.17

(58) Field of Classification Search
CPC ..... E21B 17/07; E02C 3/00; E04H 12/18; E04H 12/14; E04H 12/10; E04H 12/08
USPC ..... 52/123.1, 111, 117, 118, 120, 745.18, 52/745.17, 114, 116; 254/5 C, 250, 258, 254/261
See application file for complete search history.

(56) References Cited

U.S. PATENT DOCUMENTS 2,268,796 A 1/1942 Brauer ..... 189/15
2,429,010 A 10/1947 Woolslayer et al.

(Continued)

FOREIGN PATENT DOCUMENTS

GB 195862 3/1922
GB 1 478 648 9/1974 ..... F16B 21/00

(Continued)

OTHER PUBLICATIONS

PCT/GB2009/050202 Partial International Search Report and Written Opinion (Jan. 27, 2011).

(Continued)

*Primary Examiner* — Phi A
(74) *Attorney, Agent, or Firm* — Amerson Law Firm, PLLC

(57) ABSTRACT

Generally, the subject matter disclosed herein is directed to, among other things, systems and methods for making up pivotably pinned structural connections that may be used for erecting drilling rig masts. One illustrative system includes a drilling rig mast having at least one support leg, a drilling rig mast support having at least one mast support shoe, and a pinned connection between the at least one support leg and the at least one mast support shoe. Additionally, the pinned connection of the disclosed system includes a pin, an oversized hole having at least a first hole portion, and a removable plug that is adapted to be inserted into the oversized hole, wherein the removable plug has at least a first plug surface portion, and wherein the first hole portion and the first plug surface portion define at least part of a pin hole that is adapted to receive the pin.

27 Claims, 20 Drawing Sheets

(56) References Cited

U.S. PATENT DOCUMENTS

| | | | | | |
|---|---|---|---|---|---|
| 2,583,072 | A | | 1/1952 | Wilson | |
| 2,617,500 | A | | 11/1952 | Cardwell | 52/115 |
| 2,692,031 | A | | 10/1954 | Woolslayer et al. | |
| 2,701,039 | A | | 2/1955 | Woolslayer et al. | 52/292 |
| 2,703,634 | A | | 3/1955 | Lee | 52/115 |
| 2,804,948 | A | | 9/1957 | Woolslayer et al. | 52/118 |
| 2,857,993 | A | | 10/1958 | Terrell | 189/11 |
| 2,975,910 | A | | 3/1961 | Conrad | 212/300 |
| 2,993,570 | A | | 7/1961 | Bender | 52/118 |
| 3,033,527 | A | | 5/1962 | Hart | 254/323 |
| 3,109,523 | A | | 11/1963 | Moller | 52/115 |
| 3,156,328 | A | | 11/1964 | Bender | |
| 3,201,091 | A | | 8/1965 | Woolslayer et al. | 51/120 X |
| 3,228,151 | A | * | 1/1966 | Woolslayer et al. | 52/64 |
| 3,262,237 | A | | 7/1966 | Jenkins et al. | 52/116 |
| 3,333,377 | A | | 8/1967 | Woolslayer et al. | 52/116 |
| 3,340,938 | A | | 9/1967 | Wilson | 173/28 |
| 3,483,933 | A | | 12/1969 | Dyer | 173/39 |
| 3,749,183 | A | | 7/1973 | Branham et al. | 173/151 |
| 3,807,109 | A | | 4/1974 | Jenkins et al. | 52/120 |
| 3,922,825 | A | | 12/1975 | Eddy et al. | 52/116 |
| 3,942,593 | A | | 3/1976 | Reeve, Jr. et al. | 173/23 |
| 3,981,485 | A | | 9/1976 | Eddy et al. | 254/186 R |
| 3,987,594 | A | | 10/1976 | Rao et al. | 52/111 |
| 4,005,779 | A | | 2/1977 | Andrews | 212/87 |
| 4,021,978 | A | * | 5/1977 | Busse et al. | 52/118 |
| 4,024,924 | A | | 5/1977 | Hauck | 173/151 |
| 4,103,503 | A | | 8/1978 | Smith | 61/97 |
| 4,105,347 | A | | 8/1978 | Gossage | 403/157 |
| 4,135,340 | A | | 1/1979 | Cox et al. | 52/115 |
| 4,138,805 | A | | 2/1979 | Patterson | 52/118 |
| 4,221,088 | A | | 9/1980 | Patterson | 52/116 |
| 4,267,675 | A | | 5/1981 | Cochran | 52/118 |
| 4,269,009 | A | | 5/1981 | Lawrence | 52/116 |
| 4,269,395 | A | | 5/1981 | Newman et al. | 254/386 |
| 4,290,495 | A | | 9/1981 | Elliston | 175/85 |
| 4,292,772 | A | | 10/1981 | Borg et al. | 52/118 |
| 4,305,237 | A | | 12/1981 | Borg et al. | 52/116 |
| 4,366,650 | A | | 1/1983 | Patterson | 52/118 |
| 4,368,602 | A | | 1/1983 | Manten | 52/115 |
| 4,371,041 | A | | 2/1983 | Becker et al. | 173/28 |
| 4,371,046 | A | | 2/1983 | Reed | 175/57 |
| 4,375,892 | A | | 3/1983 | Jenkins et al. | 280/43.23 |
| 4,438,904 | A | | 3/1984 | White | 254/311 |
| 4,471,587 | A | | 9/1984 | Ahmad et al. | |
| 4,478,015 | A | | 10/1984 | Lawrence et al. | 52/120 |
| 4,489,526 | A | | 12/1984 | Cummins | 52/125.6 |
| 4,569,168 | A | | 2/1986 | McGovney et al. | 52/122.1 |
| 4,587,778 | A | | 5/1986 | Woolslayer et al. | 52/116 |
| 4,591,006 | A | | 5/1986 | Hutchison | 175/52 |
| 4,616,454 | A | * | 10/1986 | Ballachey et al. | 52/115 |
| 4,630,425 | A | | 12/1986 | Reed | 52/45.18 |
| 4,677,444 | A | * | 6/1987 | Perek | 343/882 |
| 4,684,314 | A | | 8/1987 | Luth | 414/745 |
| 4,697,779 | A | * | 10/1987 | Guislain | 248/530 |
| 4,757,592 | A | | 7/1988 | Reed | 29/429 |
| 4,769,959 | A | * | 9/1988 | Lindsey | 52/40 |
| 4,821,816 | A | | 4/1989 | Willis | 175/57 |
| 4,831,795 | A | | 5/1989 | Sorokan | 52/120 |
| 4,837,992 | A | | 6/1989 | Hashimoto | 52/118 |
| 4,899,832 | A | | 2/1990 | Bierscheid, Jr. | 173/23 |
| 4,932,175 | A | | 6/1990 | Donnally | 52/118 |
| 5,107,940 | A | | 4/1992 | Berry | 175/85 |
| 5,109,934 | A | | 5/1992 | Mochizuki | 175/170 |
| 5,251,709 | A | | 10/1993 | Richardson | 175/1 |
| 5,342,020 | A | | 8/1994 | Stone | 254/269 |
| 5,425,435 | A | | 6/1995 | Gregory | 188/77 W |
| 5,709,277 | A | | 1/1998 | Geldner | 175/203 |
| 5,921,329 | A | | 7/1999 | Armstrong | 175/57 |
| 6,029,951 | A | | 2/2000 | Guggari | 254/269 |
| 6,182,945 | B1 | | 2/2001 | Dyer et al. | 254/340 |
| 6,474,926 | B2 | | 11/2002 | Weiss | 414/332 |
| 6,523,319 | B2 | | 2/2003 | Bockhorn et al. | 52/651.01 |
| 6,634,436 | B1 | | 10/2003 | Desai | 173/1 |
| 6,848,515 | B2 | | 2/2005 | Orr et al. | 173/1 |
| 6,860,337 | B1 | | 3/2005 | Orr et al. | 173/28 |
| 6,944,547 | B2 | | 9/2005 | Womer et al. | 702/7 |
| 6,962,030 | B2 | | 11/2005 | Conn | 52/741.1 |
| 6,994,171 | B2 | | 2/2006 | Orr et al. | 173/28 |
| 7,155,873 | B2 | | 1/2007 | Palidis | 52/702 |
| 7,210,670 | B2 | | 5/2007 | Franks | 254/294 |
| 7,246,471 | B2 | | 7/2007 | Riemann et al. | 52/283 |
| 7,306,055 | B2 | | 12/2007 | Barnes | 175/57 |
| 7,308,953 | B2 | | 12/2007 | Barnes | 175/203 |
| 7,357,616 | B2 | | 4/2008 | Andrews et al. | 414/332 |
| 7,377,335 | B2 | | 5/2008 | Jones et al. | 175/57 |
| 7,413,393 | B1 | | 8/2008 | Barnes | 414/373 |
| 8,047,303 | B2 | | 11/2011 | Donnally et al. | 175/57 |
| 8,250,816 | B2 | | 8/2012 | Donnally et al. | 52/123.1 |
| 2004/0211572 | A1 | | 10/2004 | Orr et al. | 173/1 |
| 2004/0211598 | A1 | | 10/2004 | Palidis | 175/162 |
| 2004/0212598 | A1 | | 10/2004 | Kraus et al. | 345/168 |
| 2004/0240973 | A1 | | 12/2004 | Andrews et al. | 414/332 |
| 2005/0193645 | A1 | | 9/2005 | Barnes | 52/120 |
| 2005/0194189 | A1 | | 9/2005 | Barnes | 175/122 |
| 2005/0236790 | A1 | | 10/2005 | Carter | 280/79.11 |
| 2006/0213653 | A1 | | 9/2006 | Cunningham et al. | 166/77.1 |
| 2006/0260844 | A1 | | 11/2006 | Patton et al. | |
| 2009/0200856 | A1 | | 8/2009 | Chehade et al. | 299/30 |
| 2009/0218138 | A1 | | 9/2009 | Donnally et al. | 175/57 |
| 2009/0218139 | A1 | | 9/2009 | Donnally et al. | 175/57 |
| 2009/0218144 | A1 | | 9/2009 | Donnally et al. | 175/162 |

FOREIGN PATENT DOCUMENTS

| | | | |
|---|---|---|---|
| GB | 2 046 332 | 11/1980 | |
| JP | 57197322 | 12/1982 | E02D 7/16 |
| JP | 57197324 | 12/1982 | E02D 7/20 |
| JP | 59076326 | 5/1984 | E02D 7/16 |

OTHER PUBLICATIONS

PCT/GB2009/050202 Partial International Search Report (Aug. 17, 2010).

Brochure entitled "Mobile Rigs," National Oilwell, 8 pp., 2005.

Brochure entitled "Ideal™ Rig System," National Oilwell, 8 pp., 2004.

PCT Search Report and Written Opinion from PCT/US2012/048030 dated Oct. 16, 2013.

PCT Search Report and Written Opinion for PCT/US2013/020923 dated Feb. 18, 2014, 10 pages.

* cited by examiner

PINNED STRUCTURAL CONNECTION USING A PIN AND PLUG ARRANGEMENT

CROSS-REFERENCE TO RELATED APPLICATIONS

This application is a continuation-in-part of application Ser. No. 12/074,258, filed Feb. 29, 2008, now U.S. Pat. No. 8,549,815 which is incorporated fully herein by reference.

BACKGROUND OF THE INVENTION

1. Field of the Invention

Generally, the present disclosure relates to devices and methods for making up pivotably pinned structural connections, including, among other things, the pinned structural connections that may be used to facilitate the erection of drilling rig masts.

2. Description of the Related Art

The prior art discloses a variety of rigs used in drilling and wellbore operations and methods of rig assembly; for example, and not by way of limitation, rigs and assembly methods as disclosed in U.S. Pat. Nos. 2,857,993; 3,340,938; 3,807,109; 3,922,825; 3,942,593; 4,021,978; 4,269,395; 4,290,495; 4,368,602; 4,489,526; 4,569,168; 4,821,816; 4,831,795; 4,837,992; 6,634,436; 6,523,319; 6,994,171; 7,306,055; 7,155,873; and 7,308,953 and the references cited in these patents—all these patents incorporated fully herein for all purposes.

In many drilling operations, drilling rigs and related systems, equipment, and apparatuses are delivered to a site, assembled and then disassembled. It is important that drilling rigs and their components be easily transported and assembled. Costs associated with land rigs and associated equipment, can be calculated on a per hour or per day basis, and, therefore, efficient assembly, takedown, transport, and setup operations are desirable.

U.S. Pat. No. 3,922,825 discloses a rig with a stationary substructure base and a movable substructure base mounted thereon which is coupled to the stationary base and swings upright into an elevated position on a series of struts that are connected to the stationary base with swivel connections at each end. The movable base is otherwise stationary since neither the stationary base nor the movable base are mobile or repositionable without the use of an auxiliary crane or the like. The movable substructure base and the drill mast are raised with a winch mounted on an auxiliary winch truck.

U.S. Pat. No. 3,942,593 discloses a mobile well drilling rig apparatus which has a trailerable telescoping mast and a separate sectionable substructure assembly with a rig base, a working floor, and a rail structure. The mast is conveyed to the top of the substructure by rollers and is raised by hydraulic raising apparatus to an upright position. With such a system, the mast assembly can be relatively long when transporting it and the mast can be unstable during raising. This system uses drawlines and winch apparatus to raise the mast onto the working floor.

U.S. Pat. No. 4,021,978 discloses a telescoping mast assembly adapted for use with drill rigs and the like. The mast assembly has multiple sections, said sections being adapted for nesting one within the other in the telescoped-to-the-closed condition and each section has mutually convergent corner leg members which, when the mast assembly is extended, form concentric and in-line arrangements of the corner leg members from the base to the crown of the mast. Means are provided for connecting each mast section to its neighboring mast section upon extension thereof. In addition, means are also provided for indexing of the connector means upon extension of the mast assembly from its telescoped-to-the-closed condition.

U.S. Pat. No. 4,821,816 discloses methods of assembling a modular drilling machine which includes a drilling substructure skid which defines two spaced parallel skid runners and a platform. The platform supports a draw works mounted on a draw works skid, and a pipe boom is mounted on a pipe boom skid sized to fit between the skid runners of the drilling substructure skid. The drilling substructure skid supports four legs which in turn support a drilling platform on which is mounted a lower mast section. The legs are pivotably mounted both at the platform and at the drilling substructure skid and a pair of platform cylinders are provided to raise and lower the drilling platform. A pair of rigid, fixed length struts extend diagonally between the platform and the substructure skid away from the platform such that the struts do not extend under the platform and obstruct access to the region under the platform. The pipe boom skid mounts a pipe boom as well as a boom linkage, a motor, and a hydraulic pump adapted to power the pipe boom linkage. The substructure skid is formed in upper and lower skid portions, and leveling rams are provided to level the upper skid portion with respect to the lower skid portion. Mechanical position locks hold the upper skid in relative position over the lower skid. In one aspect such a method for assembling an earth drilling machine includes the steps of: (a) providing a modular earth drilling machine comprising a drilling substructure skid, a draw works skid, and a pipe boom skid, the drilling structure skid having a collapsible drilling substructure platform and means for receiving the draw works skid and the pipe boom skid, the draw works skid having a draw works winch, and the pipe boom skid having a pipe boom pivotably mounted to the pipe boom skid for rotation about a pivot axis, at least one hydraulic cylinder coupled between the pipe boom and the pipe boom skid to rotate the pipe boom about the pivot axis, a hydraulic pump mounted to the pipe boom skid and coupled to the hydraulic cylinder by a closed hydraulic fluid circuit, and a pipe boom skid winch; the pipe boom skid, pipe boom, hydraulic cylinder and hydraulic pump forming a modular unit which is transportable as a single unit without any disconnection of the closed hydraulic fluid circuit; (b) positioning the substructure skid at a desired drilling position; (c) utilizing the pipe boom skid winch to pull the pipe boom skid into position with respect to the substructure skid; (d) utilizing the pipe boom skid winch to pull the draw works skid into position with respect to the substructure skid; and, in one aspect, the method further including raising the collapsible drilling structure platform, including utilizing the pipe boom skid winch to lift the drilling structure platform during at least an initial stage of the raising step.

U.S. Pat. No. 4,831,795 discloses drilling derrick assemblies which provide for the elevation above ground level of the assembly's working floor which supports both the mast and the drawworks. Prior to erection, the elevatable equipment floor is carried on a supporting substructure, and a mast is pivotally connected to the elevatable floor in a reclining position. When the assembly is erected, the mast is pivotally raised and attached in place, and other rigging steps can be carried out. Through the use of an integrally mounted sling and winch assembly or, alternatively, through operation of the assembly's traveling block, the entire equipment floor is elevated to the desired level. In one aspect, a drilling structure is disclosed that has: a substructure for supporting the drilling structure on the surface through which drilling is to occur, an elevatable floor assembly which rests on the substructure in its lowered position, a reclining mast pivotally connected to the elevatable floor, a gin pole assembly mounted on the elevatable floor assembly rearwardly of the point at which the mast is pivotally connected to the elevatable floor and arranged to receive line for raising the mast, whereby the mast is raised prior to raising the elevatable floor assembly, a collapsible vertically standing elevating frame assembly mounted on the substructure and forwardly of the mast, when raised, and the forwardmost end of the elevatable floor assembly, winch means rotatably mounted in and arranged adjacent the forwardmost end of the substructure, a first elevating block means mounted in the elevatable floor and rearwardly of the elevating frame assembly, a second elevating block mounted on the elevating frame assembly at a vertical point corresponding with the level to which the elevatable floor is to be raised, an elevating line extending from the winch means and reeved about the elevating block so that motion of the winch means in one direction causes the second elevating block to move toward the first elevating block raising the elevatable floor vertically and forwardly, motion of the winch means in another direction lowering the elevatable floor vertically and rearwardly, and a brace member on each side of the drilling structure, each brace member being pivotally connected at its ends, respectively, to the substructure and the elevatable floor, the brace members being arranged in pairs forming parallel linkages thereby causing the elevatable floor assembly to be raised in an arc-like motion.

U.S. Pat. No. 6,994,171 discloses two section masts with self-aligning connections and methods with self-aligning connections for a two section mast. The methods include the steps of transporting the elongated bottom mast section to a guide frame adjacent to a well site, the bottom mast section having a pair of front legs and a pair of rear legs. An elongated top mast section is transported to the well site, the top mast section having a pair of front legs and a pair of rear legs. The legs of the bottom mast section are positioned slightly below a level of the legs of the top mast section. Thereafter, the bottom mast section is raised slightly to order to engage the top mast section while simultaneously aligning the mast sections together. The sections are thereafter pinned together. In one method of self-aligning connections for a two section mast, the method includes: transporting an elongated bottom mast section to a guide frame adjacent to a well site, the bottom mast section having a pair of front legs and a pair of rear legs so that the bottom mast section is in a substantially horizontal orientation; thereafter transporting an elongated top mast section to the well site so that the top mast section is in a substantially horizontal orientation and so that the mast sections are substantially aligned lengthwise, the top mast section having a pair of front legs and a pair of rear legs; positioning the legs of the bottom mast section slightly below a level of the legs of the top mast section; raising the bottom mast section; and simultaneously engaging and guiding the mast sections together in a final connecting orientation.

U.S. Pat. No. 7,155,873 discloses structural connectors for a drilling rig substructure; and a method and apparatus for connecting sections of a drilling rig substructure, in one aspect a structural connector is provided so that sections of a drilling rig substructure can be connected together without the use of pins or pin-type connectors. The structural connector utilizes specially-shaped fixed members connected to, and extending through, support plates that are attached to sections of a drilling rig substructure that mate with specially-shaped mating lugs that are mounted on mating lug plates that are attached to separate sections of the drilling rig substructure. When the sections of the drilling rig substructure to be connected are positioned together, the specially-shaped mating lugs engage the specially-shaped fixed members and form a high strength structural connection between the sections of the drilling rig substructure. In one aspect a structural connector is provided that has: a plurality of support plates each having a plurality of fixed support members extending therethrough, the fixed support members extending outwardly from both sides of the support plates and having side walls and contoured tops; a mating lug assembly having a plurality of mating lug plates and a plurality of mating lugs attached to each mating lug plate, each mating lug having a support notch therein; wherein the support notch of each mating lug has tapered guide surfaces at the entry point of the support notch, side walls, and a contoured top.

SUMMARY OF THE INVENTION

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

The present invention, in certain aspects, provides drilling rigs with erectable masts. In one aspect, a mast includes a bottom mast component and a second, upper or midsection component that are connected together.

In certain aspects, the present invention discloses a bottom mast section connectible to a midsection by moving a vehicle, e.g. a truck/trailer combination to place the two sections adjacent each other; connecting the bottom section to a support, e.g. but not limited to, a rig's substructure; raising, if necessary, the support or rig's substructure to which the bottom mast section is connected; and moving the vehicle to engage connections and, in one aspect, to align connections, of the bottom mast section and midsection. Once the connections have been engaged, the truck can move away and pins are used as a further securement to lock the two sections together and the truck moves away.

The present invention discloses, in certain aspects, a method for connection two parts of a mast of a drilling rig, the method including: connecting a bottom mast section to a support, the bottom mast section having bottom connection apparatus; moving a second mast section adjacent the bottom mast section, the second mast section releasably connected to a vehicle and said moving done by moving said vehicle, the second mast section having second connection apparatus; and moving the bottom mast section so that the bottom connection apparatus contacts the second connection apparatus and engages the second connection apparatus to secure the bottom mast section to the second mast section, and, in certain aspects to facilitate connection engagement and align the mast sections as one mast section is lifted.

The present invention discloses, in certain aspects, a mast system for rig operations, the mast system including: a support, a bottom mast section connected to the support; the bottom mast section having bottom connection apparatus; a second mast section adjacent and connectible to the bottom mast section, the second mast section releasably connected to a vehicle for moving the second mast section; the second mast section having second connection apparatus; and the bottom mast section movable on the support so that the bottom connection apparatus can contact the second connection apparatus and engage the second connection apparatus to secure the bottom mast section to the second mast section.

One illustrative system of the present disclosure includes, among other things, a drilling rig mast having at least one support leg, a drilling rig mast support having at least one mast support shoe, and a pinned connection between the at least one support leg and the at least one mast support shoe. Additionally, the pinned connection of the disclosed system includes a pin, an oversized hole having at least a first hole portion, and a removable plug that is adapted to be inserted into the oversized hole, wherein the removable plug has at least a first plug surface portion, and wherein the first hole portion and the first plug surface portion define at least part of a pin hole that is adapted to receive the pin.

Another illustrative system disclosed herein includes a drilling rig mast having at least one mast section, wherein the at least one mast section comprises at least one support leg, and the at least one support leg comprises a first pin hole having a substantially circular shape. The system further includes a drilling rig mast support comprising at least one mast support shoe, wherein the at least one mast support shoe comprises an oversized hole, and the oversized hole is made up of at least a first hole portion having a substantially circular shape. Additionally, the system includes, among other things, a pin that is adapted to pivotably attach the at least one support leg to the at least one support shoe, wherein the pin has a substantially circular cross section and is adapted to be inserted into the first pin hole and the oversized hole, and wherein the pin and is further adapted to be positioned adjacent to the first hole portion. Furthermore, the system also includes a removable plug that is adapted to be inserted into the oversized hole and is further adapted to maintain the position of the pin adjacent to the first hole portion, wherein the removable plug comprises at least a first plug surface portion that is adapted to be positioned adjacent to the pin, wherein the first hole portion and the first plug surface portion define at least part of a second pin hole having a substantially circular shape, and wherein the second pin hole is adapted to receive the pin.

Also disclosed herein is an illustrative method that includes, among other things, positioning a support leg of at least one mast section of a drilling rig mast proximate a mast support shoe of a drilling rig support, and aligning a first substantially circular pin hole of the support leg with an oversized hole of the mast support shoe, wherein the oversized hole is made up of at least a first hole portion having a substantially circular shape. The method also includes pivotably attaching the support leg to the mast support shoe by inserting a pin having a substantially circular cross section into the aligned holes, positioning the pin adjacent to the first hole portion, and inserting a removable plug into the oversized hole so as to substantially maintain the position of the pin adjacent to the first hole portion, wherein the removable plug has at least a first plug surface portion, and wherein the first hole portion and the first plug surface portion define a second substantially circular pin hole that is adapted to receive the pin.

BRIEF DESCRIPTION OF THE DRAWINGS

The disclosure may be understood by reference to the following description taken in conjunction with the accompanying drawings, in which like reference numerals identify like elements, and in which.

Figure 1A:
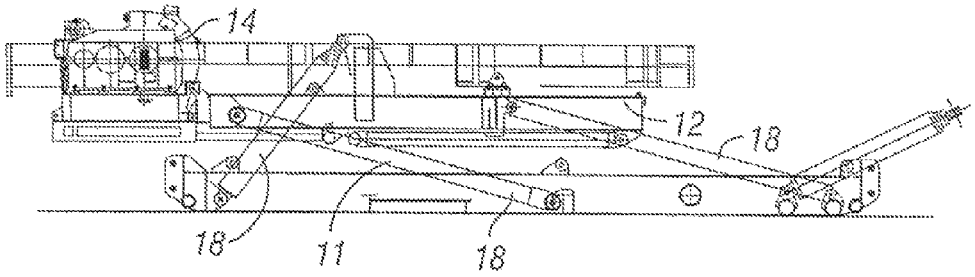
FIG. 1A is a side view of part of a drilling rig.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

FIG. 1A shows a drilling rig's substructure 11 supporting a drill floor 12 with a drawworks 14 positioned on the drill floor 12. The substructure 11 and drill floor 12 have an open area A into which equipment can be moved.

Figure 1B:
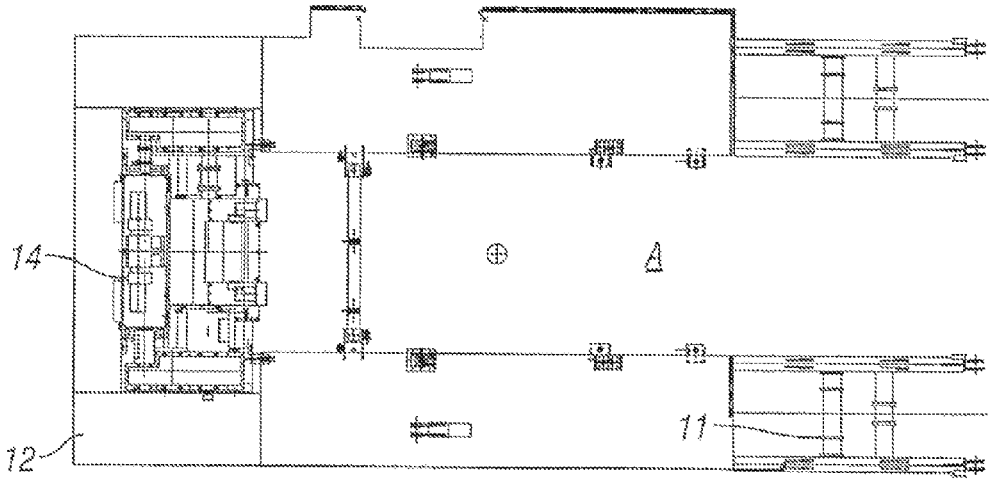
FIG. 1B is a top view of the rig parts of FIG. 1A.
Figure 1C:
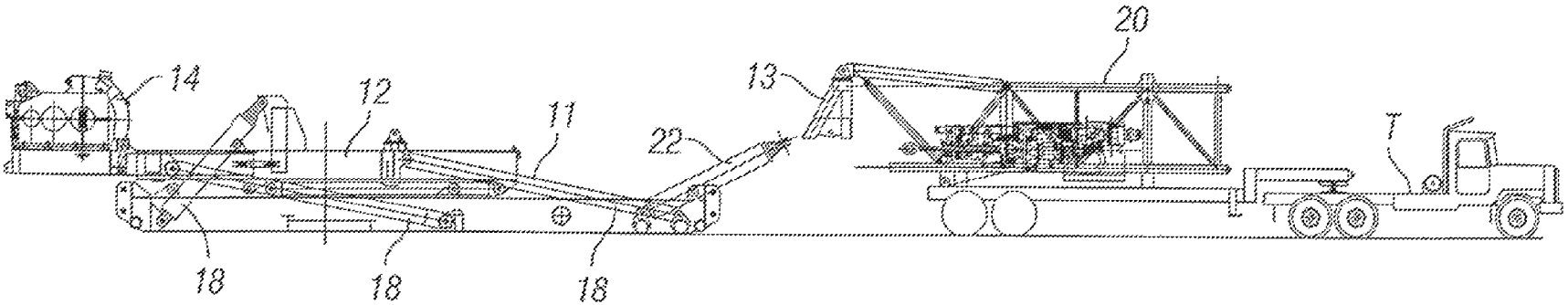
FIG. 1C is a side view which illustrates a step in a method according to the present invention for assembling and erecting a rig mast.

As shown in FIG. 1C the substructure 11 is in a lower position and a truck T has moved a bottom section 20 of a mast according to the present invention toward the drill floor 12. An A-frame 13 is connected to the bottom section 20 of the mast. Mast raising cylinders 22 are in position for connection to the bottom section 20.

Figure 1D:
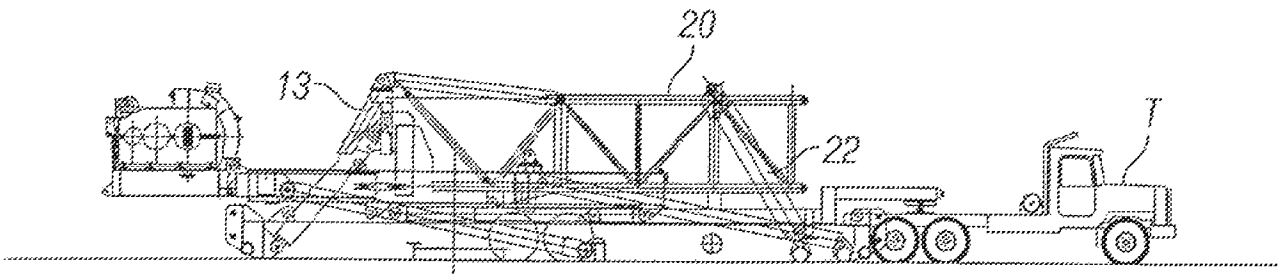
FIG. 1D is a side view which illustrates a further step in the method of FIG. 1C.

As shown in FIG. 1D, the truck T is stopped moving the bottom section 20 into the area A. The bottom section 20 is then connected to the mast raising cylinders 22. The positions substructure raising cylinders 18 are adjusted and the A-frame 13 is connected to the drill floor 12.

Figure 1E:
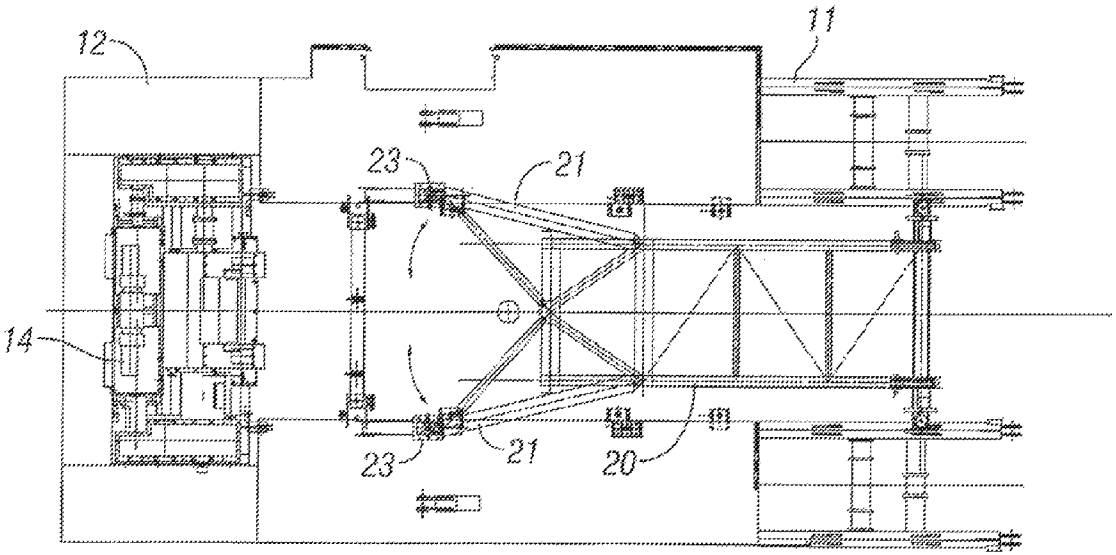
FIG. 1E is a top view of the step of FIG. 1D.

As shown in FIG. 1E, legs 21 of the mast 20 are swung open for bolting to mast shoes 23 of the drill floor 12. The mast raising cylinders 22 are then extended and the truck T is moved away. The mast raising cylinders 22 are then retracted to lower the bottom section 20.

Figure 1F:
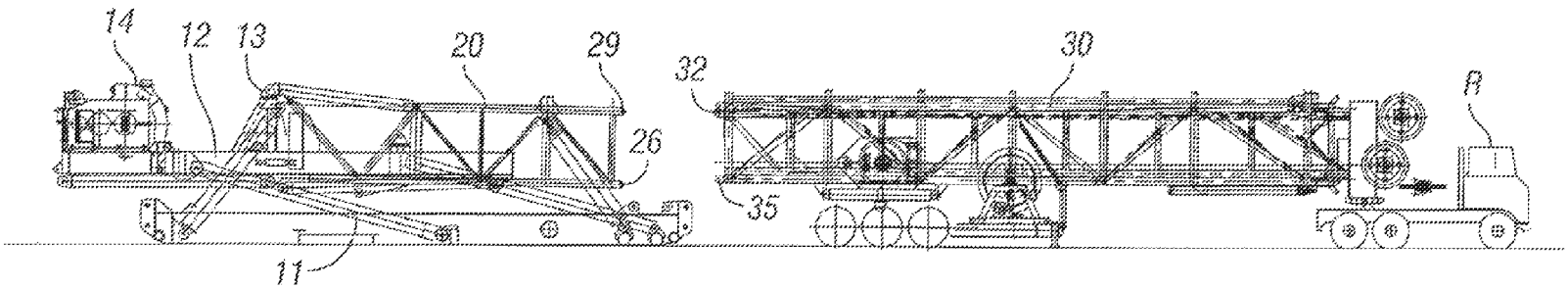
FIG. 1F is a side view of a further step in the method of FIG. 1C.
Figure 1G:
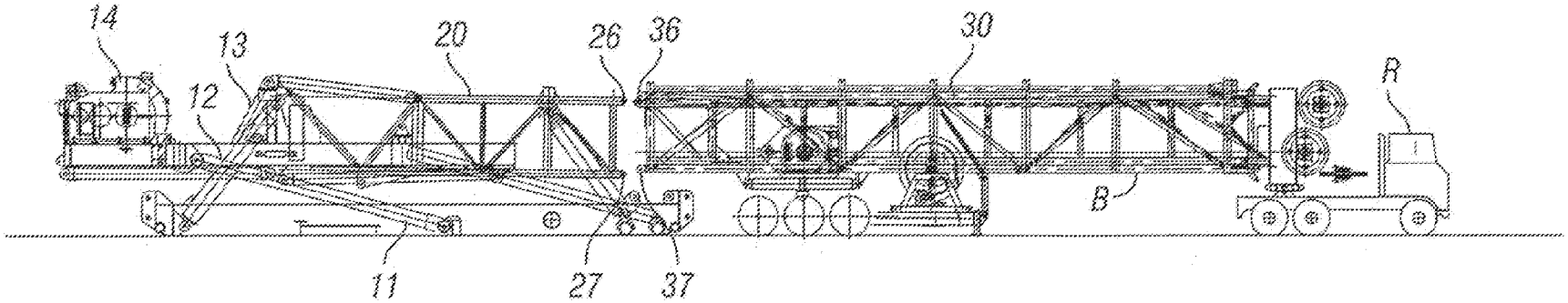
FIG. 1G is a side view of a further step in the method of FIG. 1C.

As shown in FIG. 1F, a truck R has moved a midsection 30 of a mast according to the present invention toward the bottom section 20. FIG. 1G shows the truck R stopped after moving the midsection 30 adjacent a projecting end of the bottom section 20. The sub cylinder 18 and the mast cylinder 22 are raised to raise jaw members according to the present invention of the bottom section 20 adjacent corresponding connection members 32 according to the present invention of the midsection 30.

FIGS. 1I-1L show the bottom section 20 and FIGS. 1M-1P show the midsection 30. The bottom section 20 has two legs 20*a* each with a jaw member 29 having a slot 23 in each of two spaced-apart plates 24. A space 25 is formed between ends of the plates 24. A throat 25*a* is formed between flared out portions 25*b* of the plates 24 (or separate pieces 25*b* are used connected to the plates). Two legs 20*r* each have a connection member 26 with two spaced-apart plates 27 and holes 28. A throat 27*a* is formed between flared out portions 27*b* of the plates 27. A throat 27*c* is formed between flared out portions 27*d* of the plates 27. In certain aspects of the present invention, any one or two throats described above may be deleted, or they may all be deleted.

As shown in FIGS. 1F-1L, the midsection 30 has two legs 31 each with a connection member 32 having a transverse bar 33. Each leg has a connection member 35 with holes 38 corresponding, upon section connection, to the location of the holes 28 of the connection members 26.

Ends of the connection members 32 are sized for movement into the spaces 25 of the jaw members 29 and the bars 33 are sized for receipt in the slots 23. The connection members 35 are sized for receipt between the plates 27 of the connection members 26 and pins are insertable through the holes 28, 38 to lock the two mast sections together. If one jaw member connects to one connection member and the other jaw-member/connection/member connection has not been fully effected, raising of the bottom section will force the other connection member into contact with and engagement with the other jaw member, facilitating alignment of the two sections and their connection.

The truck R moves the midsection 30 adjacent the bottom section 20 so that ends of the connection members 32 move into the spaces 25 of the jaw member 29 and the bars 33 then move into the slots 23. The connection members 35 are moved through the throats 27*a* between the plates 27 and pins are inserted through the holes 28, 38 to lock the two sections together.

It is within the scope of this invention to delete one of the jaw members 29 and to releasably connect the two sections of the mast together at the location of the deleted jaw member 29 in any suitable fashion (e.g., but not limited to) with bolt(s) bolting the two sections together.

Figure 1H:
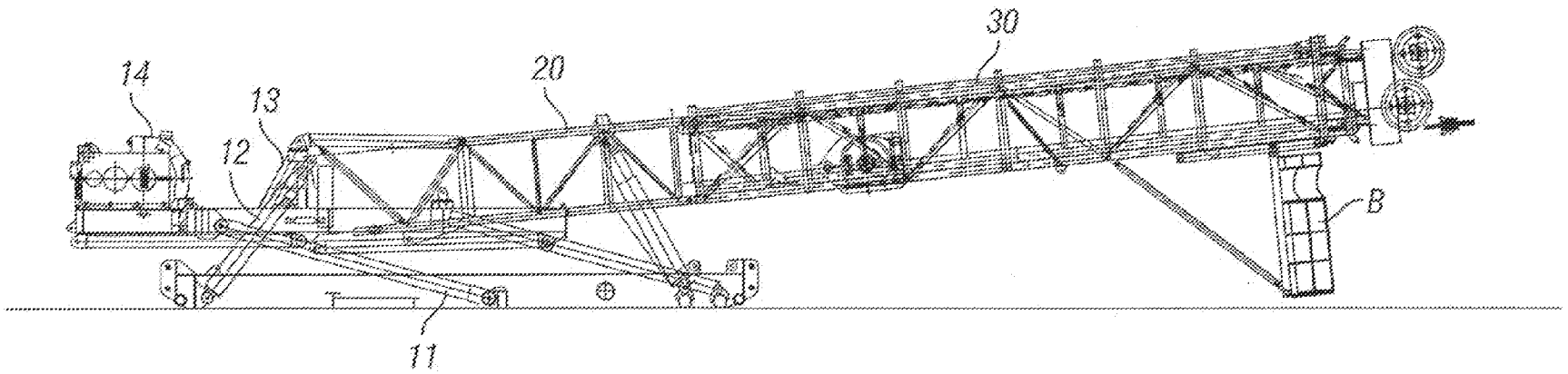
FIG. 1H is a side view of a further step in the method of FIG. 1C.
Figure 1I:
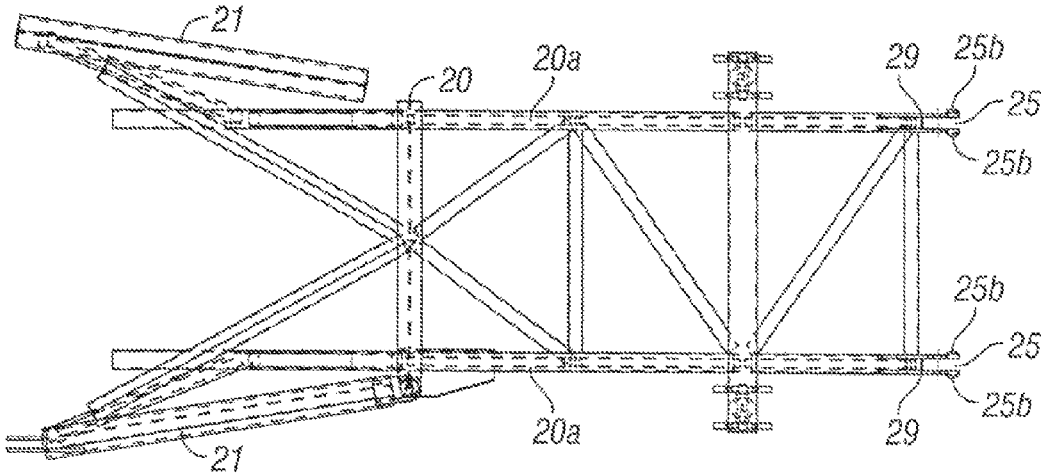
FIG. 1I is a top view of a bottom section of a mast as assembled in FIGS. 1C-1H.
Figure 1J:
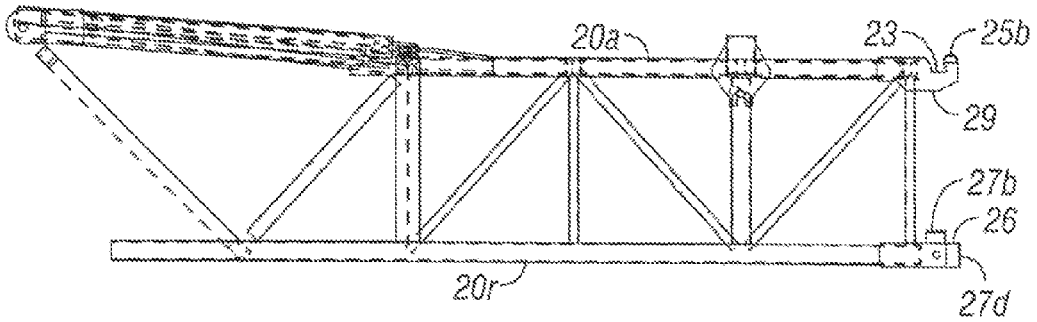
FIG. 1J is a side view of the bottom section of FIG. 1I.
Figure 1K:
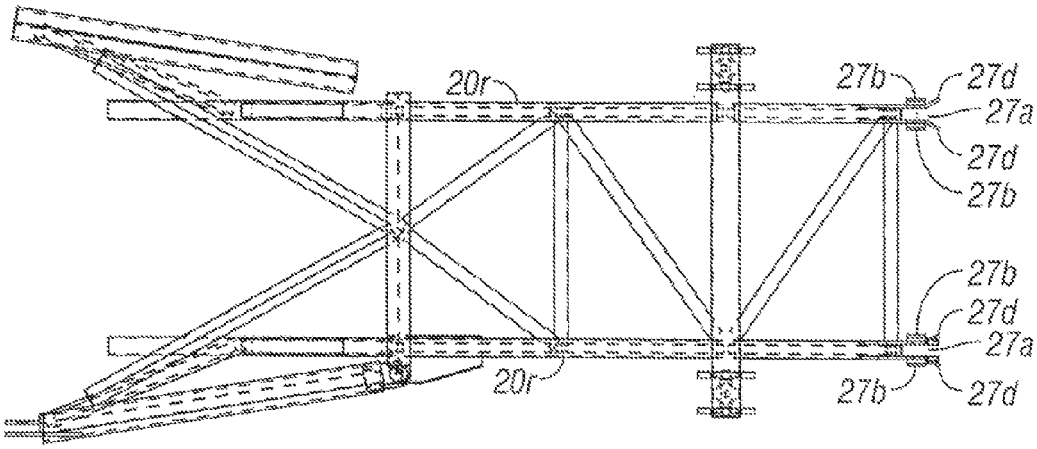
FIG. 1K is a bottom view of the bottom section of FIG. 1I.
Figure 1L:
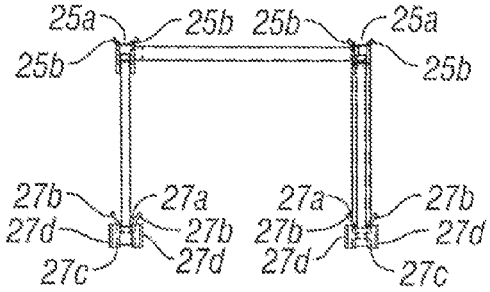
FIG. 1L is an end view along the bottom section of FIG. 1I.
Figure 1M:
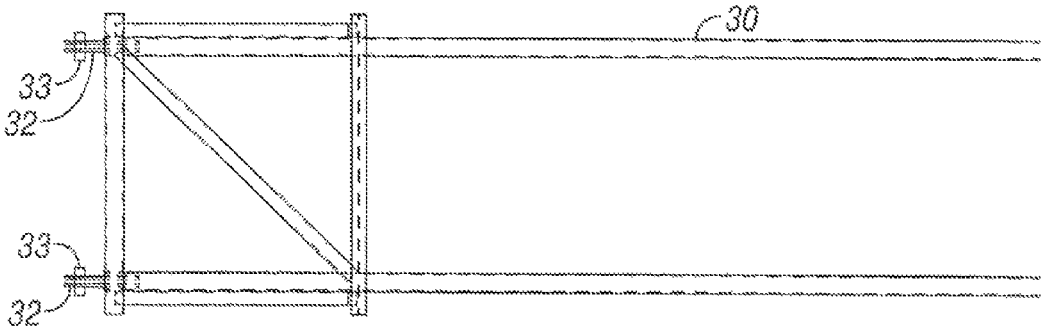
FIG. 1M is a side view of the bottom midsection of a mast as assembled in FIG. 1F, et seq.
Figure 1N:
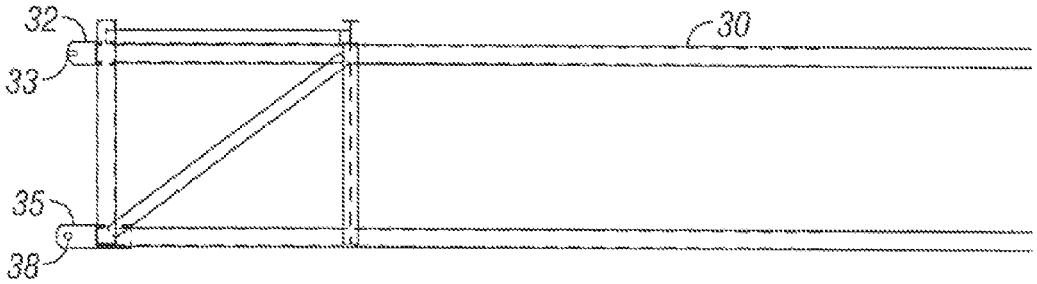
FIG. 1N is a side view of the bottom midsection of FIG. 1M.
Figure 1O:
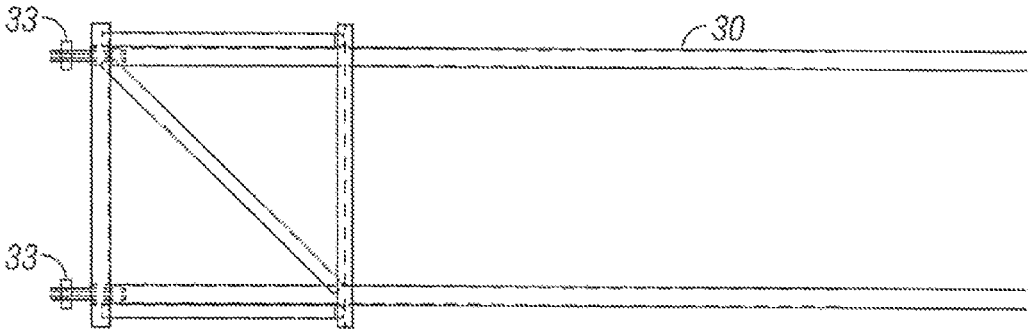
FIG. 1O is a bottom view of the bottom midsection of FIG. 1M.
Figure 1P:
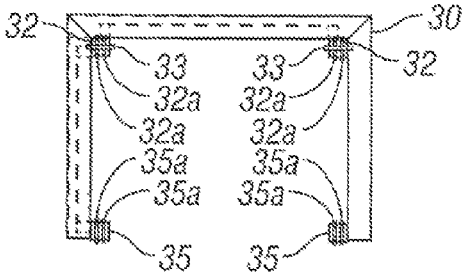
FIG. 1P is an end view along the bottom section of FIG. 1N.

Upon interengagement of the connection members of the sections 20, 30, as shown in FIG. 1H, and insertion of locking pins through the holes 28, 38, the mast raising cylinders 22 are partially extended so the truck R can move away. The mast raising cylinders 22 are then further extended and a racking board B is opened.

Figure 2:
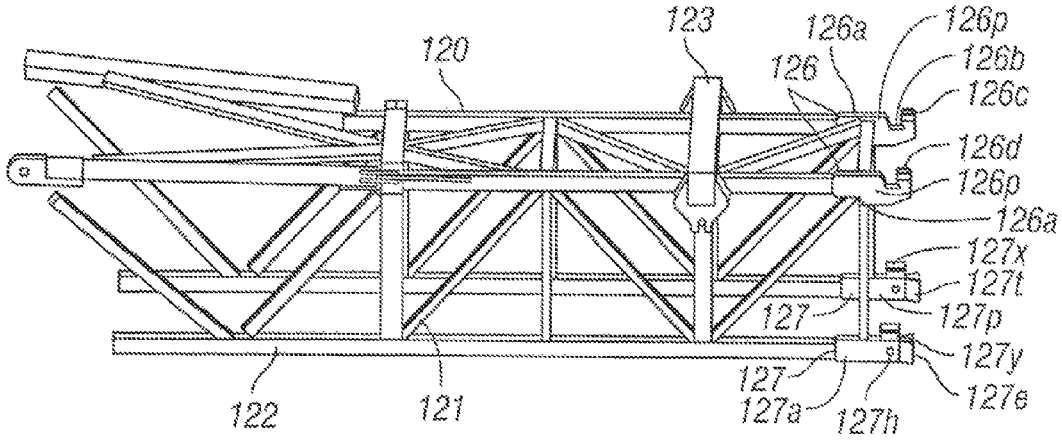
FIG. 2 is a perspective view of a bottom section of a mast according to the present invention connected to rig substructure (shown partially)
Figure 3:
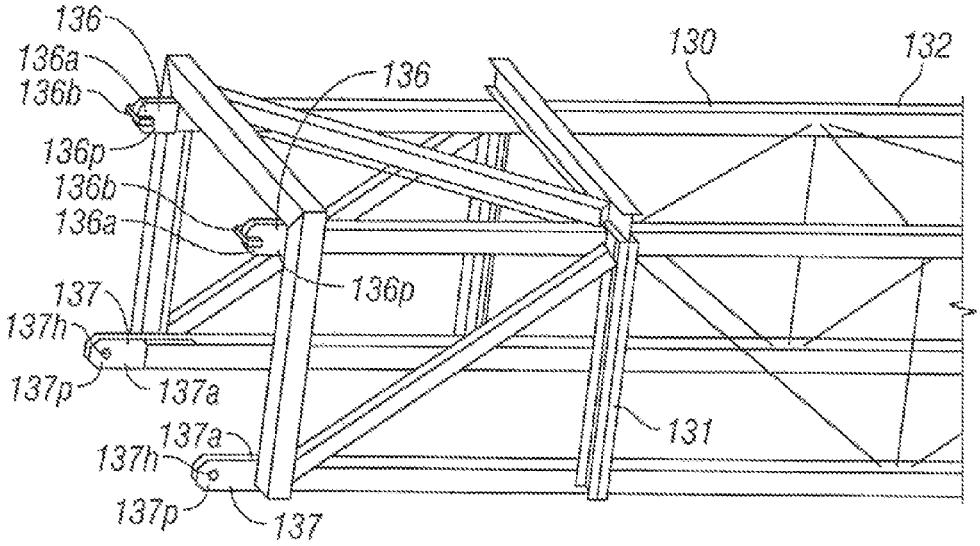
FIG. 3 is a perspective view of a midsection of a mast according to the present invention.

FIG. 2 shows a bottom section 120 of a mast according to the present invention (like the bottom section 20); and FIG. 3 shows a midsection 130 of a mast according to the present invention (like a midsection 30).

As shown in FIG. 2, the bottom section 120 has four legs 122 and a series of interconnecting beams 121. A square tube 123 spans two of the legs 122. Each of two of the legs 122 has a jaw member 126 like the jaw members 29, FIG. 1F and the two opposite legs 122 have end connection members 127 (like the connection members 27, FIG. 1F).

A jaw member 126 has a body 126*a* which includes two spaced-apart plates 126*p* secured to a leg 122; a slot 126*b*; an upright projection 126*c*; and a throat 126*d* (like the throat 25*a*, FIG. 1L) between two flared out parts which decreases in width from an outer end to an inner end.

An end connection member 127 has a body 127*a* with two spaced-apart plates 127*p* each with a flared end 127*e* so that the plates 127*p* together form an open throat 127*t* which decreases in width from the outer end to the inner end. Each plate 127*p* has a hole 127*h* for receiving a removable locking pin. A throat 127*x* is formed between parts 127*y*. The throat 127*t* is like the throat 27*c*, FIG. 1L and the throat 127*x* is like the throat 27*a*, FIG. 1L.

As shown in FIG. 3, the midsection 30 has four legs 132 and a series of interconnecting beams 131. Each of two of the legs 132 has a connection member 136 and the two opposite legs have a connection member 137.

Each connection member 136 has a body 136*a* made of two plates 136*p*. A bar 136*b* is held by and projects slightly from the plates 136*p*.

Each connection member 137 has a body 137*a* made of two plates 137*p*. Each plate 137*p* has a hole 137*h* for receiving a removable locking pin.

Figure 4A:
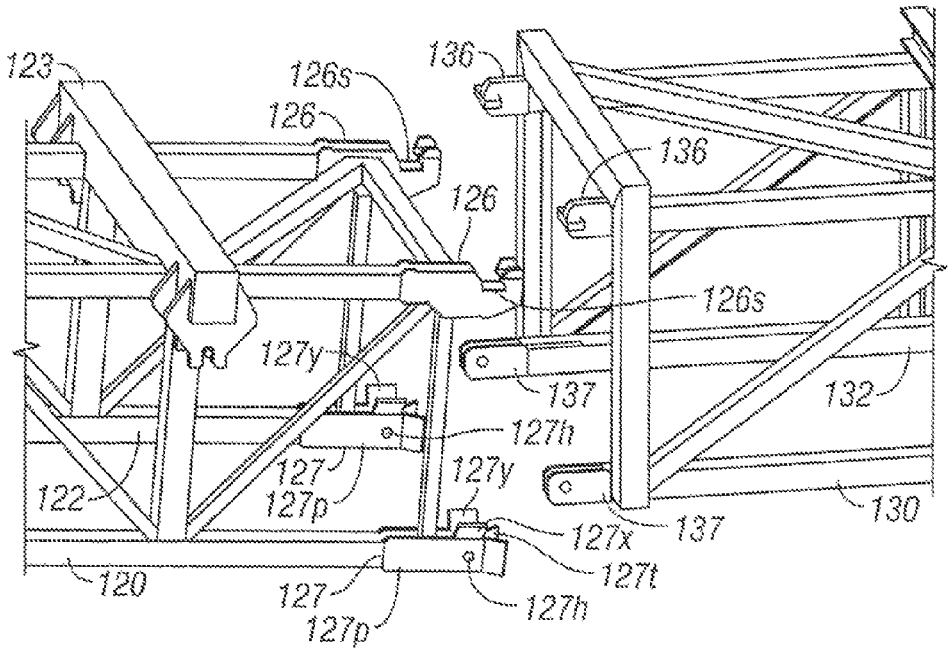
FIG. 4A is a perspective view illustrating a bottom section as in FIG. 2 for connection to a midsection as in FIG. 3.
Figure 4B:
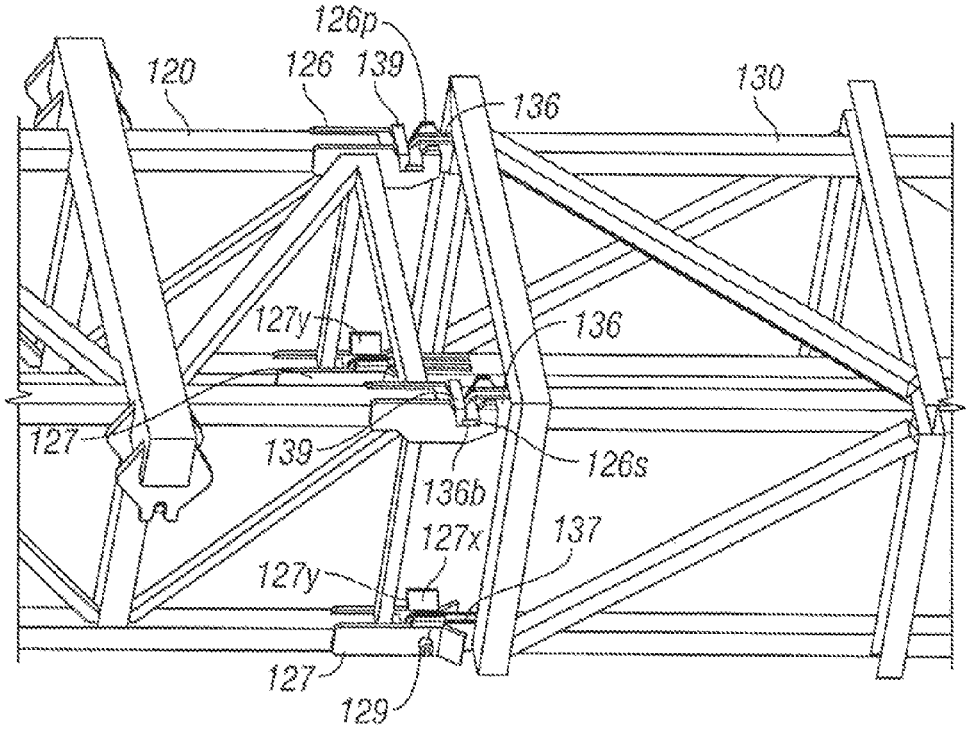
FIG. 4B shows the bottom section of FIG. 4A connected to the midsection of FIG. 4A.
Figure 4C:
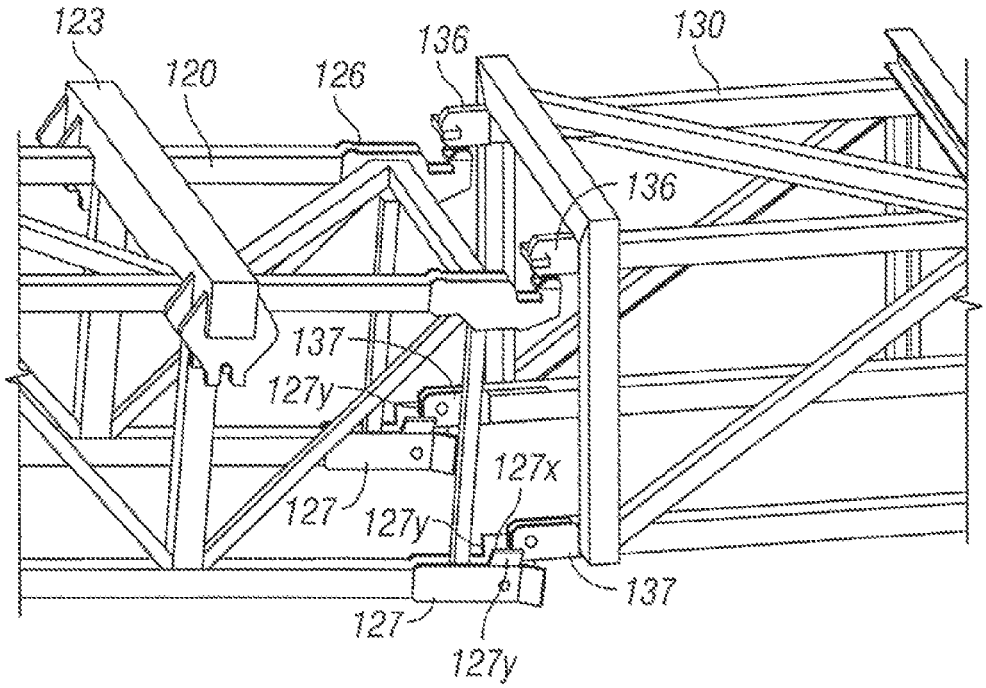
FIG. 4C is a perspective view illustrating a step in a method of connecting the sections shown in FIG. 4A.
Figure 4D:
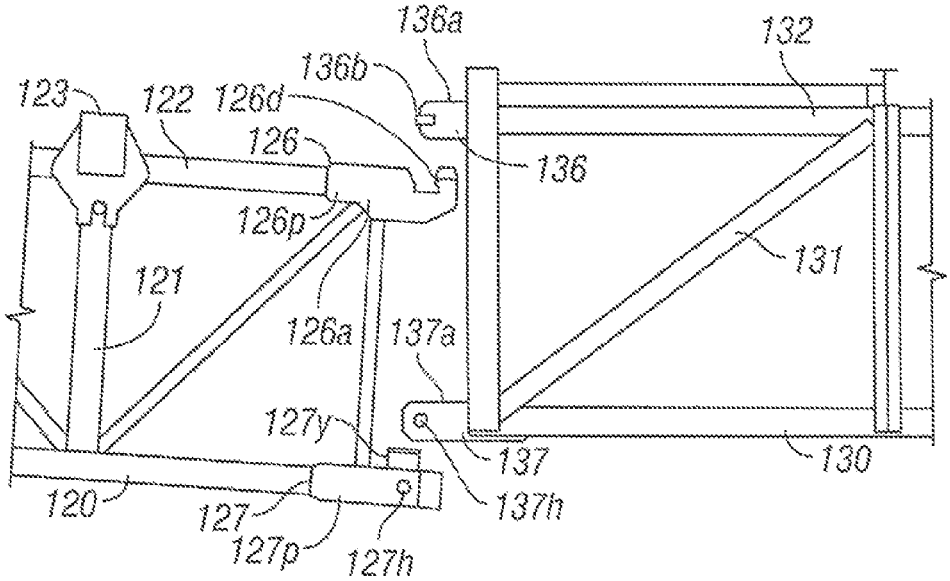
FIG. 4D is a side view illustrating a further step in the method of FIG. 4C.
Figure 4E:
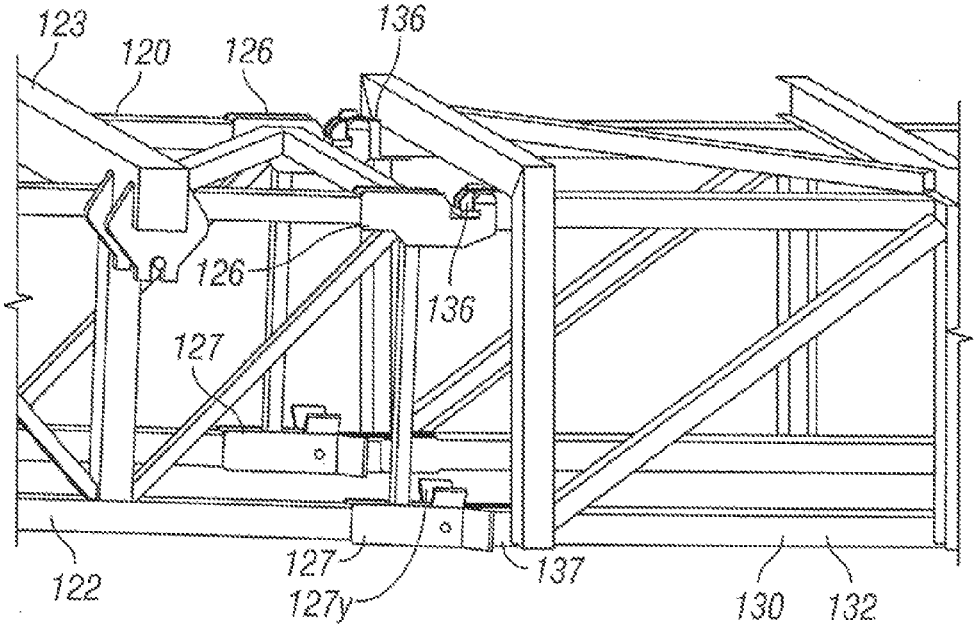
FIG. 4E is a perspective view of a further step in the method.

As shown in FIGS. 4A-4C the midsection 130 has been moved on a truck into position adjacent the bottom section 120 (e.g. as in FIG. 1F and prior to FIG. 1G). The truck moves the midsection 130 directly above the bottom section 120 (FIG. 4C). A substructure (e.g. like the substructure 11) raises the bottom section. For mating of the upper mast section initially to the lower mast section, both sections are oriented so that they are sloping downwards towards each other to insure that the upper jaws 126 come to a mating position before the opposite connections. The jaws 126 are then brought into contact with the mating bars 136*b* of the lower connection members by raising the lower mast section using the hydraulic cylinders.

Figure 4F:
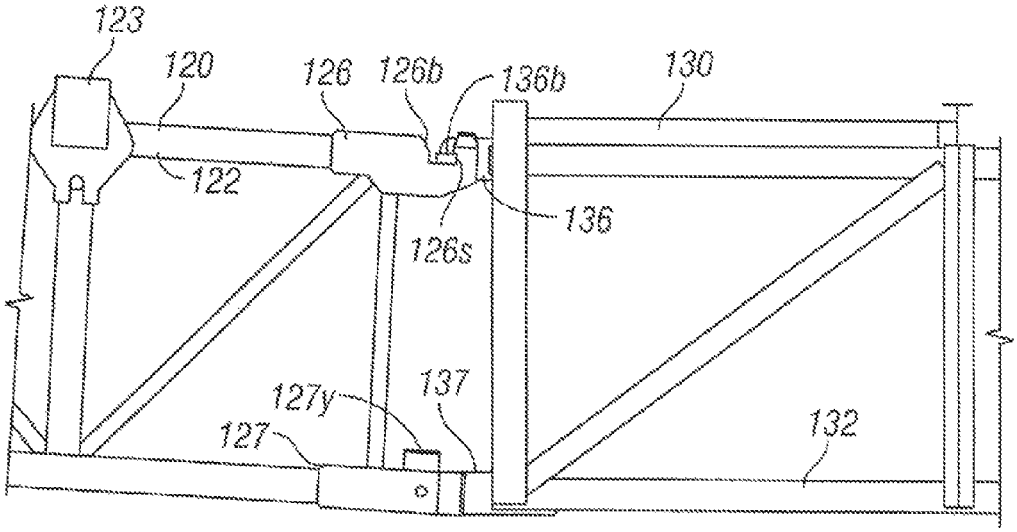
FIG. 4F is a side view of the step of FIG. 4E.
Figure 4G:
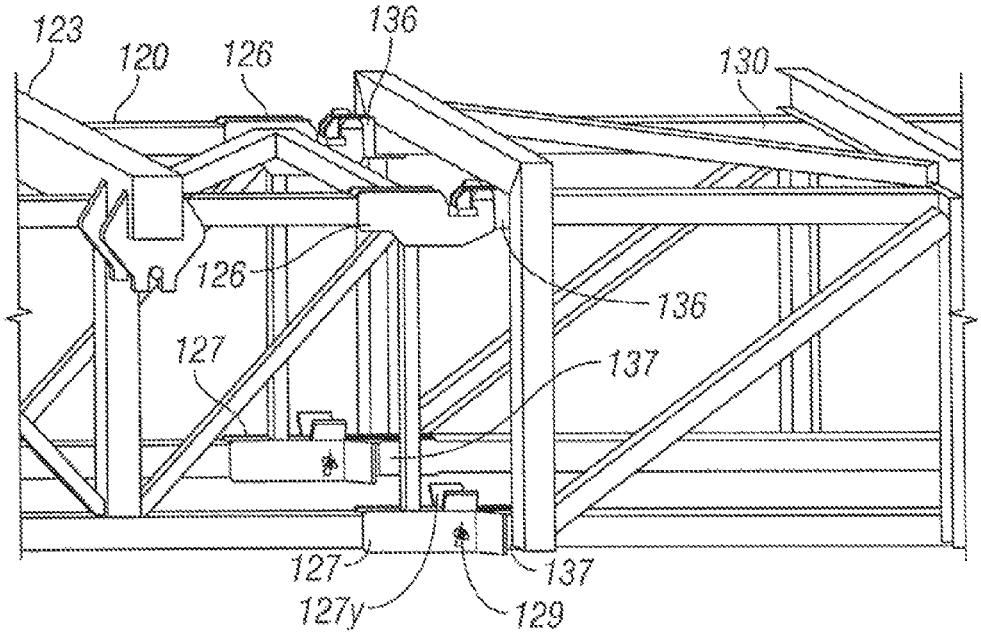
FIG. 4G is a perspective view illustrating a further step in the method.

Continued raising then forces the mating ends of the mast sections upwards rotating them so that the gap between the lower connections is forced closed. The flared design on the lower connections forces them into alignment as they are forced closed. As shown in FIGS. 4F and 4G, the hydraulic cylinders (substructure raising cylinders and mast raising cylinders) have been raised to raise the bottom section 120 level with the midsection 130, moving the connection member 137 fully into the connection member 127. Pins 129 have not yet been inserted into and through the holes 127*h*, 137*h*. The bars 136*b* are in the slots 126*s*. The two sides of the mast can be misaligned when the connection method starts which can result in a jaw and bar on one side being tensioned while the opposite jaw and bar are floating—but this is self-corrected as the raising process continues and the total mast begins to be lifted.

Figure 4H:
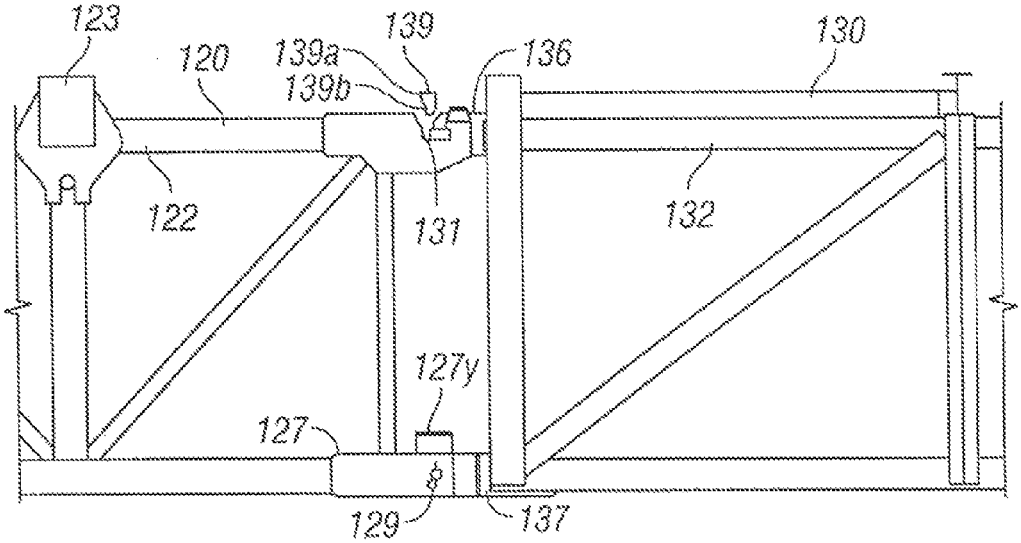
FIG. 4H is a side view of the step shown in FIG. 4G.

As shown in FIGS. 4G and 4H, the substructure raising cylinders and the mast raising cylinders have been adjusted to install the pins 129 have been inserted through the connection member 127, 137. Pins 139 have not yet been inserted into the slots 126*b*. Each pin 139 has a body 139*a* with a lower projection 139*c* which is sized and configured to fit into a space 131 formed by surfaces of the connection member 126 and of the bars 136*b*.

Once the pins 139 have been inserted and the two mast sections 120, 130 are connected, the mast is ready to be raised.

In some embodiments of the present invention, the support legs of the drilling rig mast may be attached to the mast support shoes by means of removable cylindrically shaped pins, rather than being bolted to the shoes as described with respect to FIG. 1E above. In such embodiments, the support legs of the drilling rig mast may be attached to the mast support shoes on the drilling rig floor or substructure by aligning pin holes in the "feet", or lower ends, of the support legs with pin holes in the mast support shoes. Thereafter, the removable pins may be installed by sliding, or driving, the pins into place. However, in typical configurations, the clearances between each of the pin holes and the removable pins may be quite small, which, depending on the overall rig structure design, may be necessary so as to properly transfer the loads on and from the drilling rig mast to the mast support shoes and the rig substructure, while still permitting the drilling rig mast to be pivoted about the pins during rig erection. As such, the feet of each support leg may need to be very closely aligned with the shoes before the removable pins can be installed. Furthermore, there is often a desire to install the drilling rig mast from the trailer of the truck that is used to transport the mast to the drilling site, directly to the mast support shoes. In some instances, this activity can create additional difficulties in ensuring that the truck/trailer is properly located and positioned during the pin hole alignment process, which may be a time consuming and laborious step in the overall erection of the drilling rig mast. Accordingly, this method of direct drilling rig mast installation is oftentimes abandoned, resulting in the reversion to more traditional, and significantly more costly, erection methods, such as the use of a large crane to lift and manipulate the mast.

FIGS. 5A-5F illustrate a drilling rig system and method for erecting a drilling rig mast using a novel pinned structural connection of the present disclosure, which will hereinafter be described in detail.

Figure 5A:
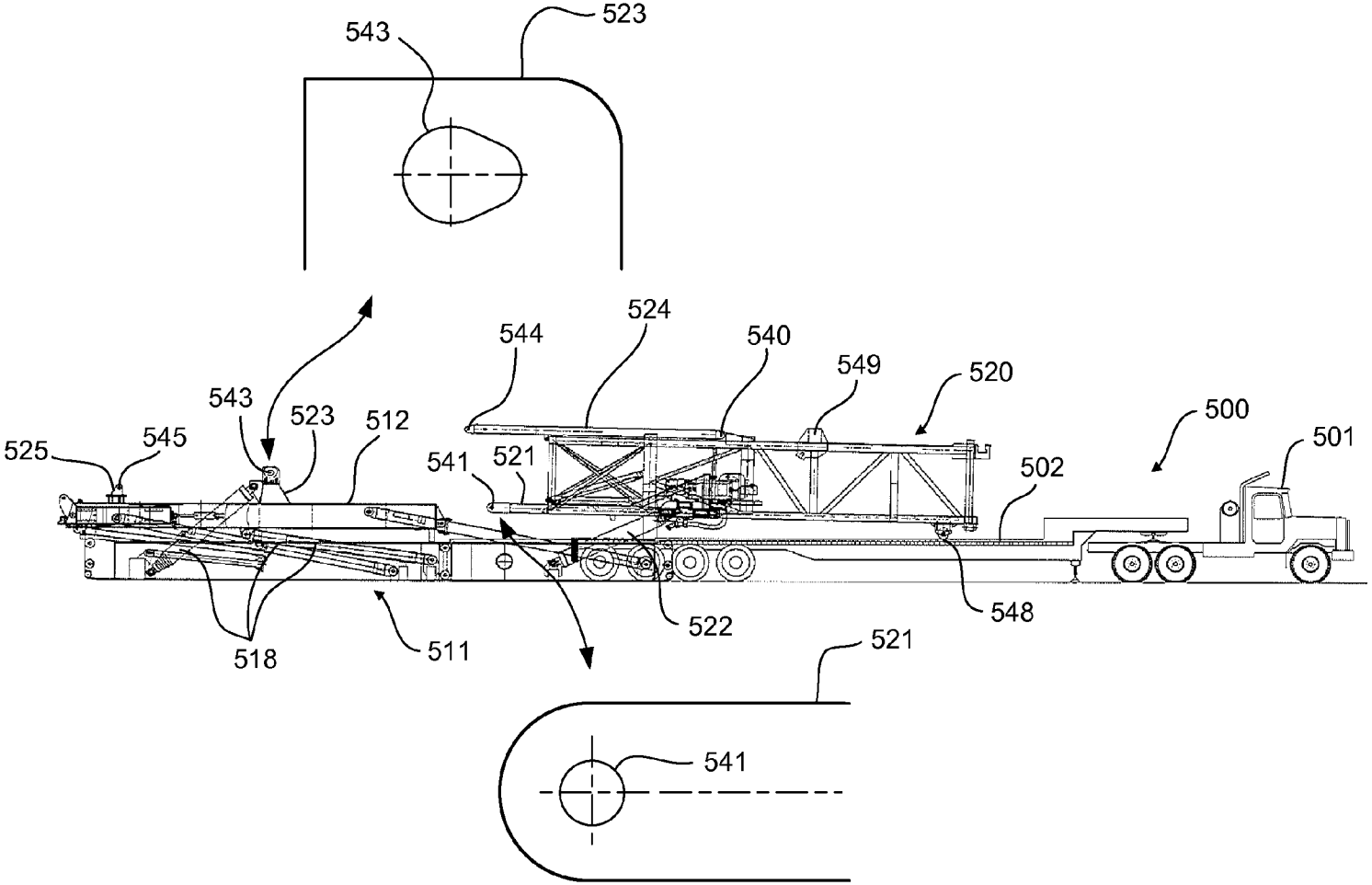
FIGS. 5A-5E are elevation views of a drilling rig system showing various steps in one embodiment of the assembly and erection of an illustrative drilling rig mast using an illustrative pinned structural connection of the present disclosure.

As shown in FIG. 5A, a bottom section 520 of a drilling rig mast may be positioned on a trailer 502 of a truck/trailer combination 500 in preparation for moving the bottom section 520 to a drilling rig substructure 511, which, in some illustrative embodiments, may be substantially similar to the substructure 11 depicted in FIGS. 1A-1H and described above. In some embodiments, the bottom section 520 may include support legs 521, and the support legs 521 may have pin holes 541 located at the lower end thereof, and which may be used to pivotably attach the bottom section 520 to the drilling rig substructure 511, as will be described in detail below. The bottom section 520 may also include support struts 524, which may be pivotably attached to the bottom section 520 by pinned connections 540. Furthermore, as with the support legs 521, the support struts 524 may also have pin holes 544 located at a lower end thereof, and which may be used to attach the support struts 524 to the drilling rig substructure 511.

In certain embodiments of the present disclosure, the drilling rig substructure 511 may include a drilling floor 512 and a plurality of substructure raising apparatuses 518, such as hydraulic cylinders and the like, that may be pivotably attached to substructure 511 and drilling rig floor 512. In some illustrative embodiments, the drilling rig substructure 511 may include mast support shoes 523 to which the support legs 521 may be pivotably attached. The mast support shoes 523 may be located on the drilling floor 512, and may each have pin holes 543 corresponding to the respective pin holes 541 at the lower ends of the support legs 521. In other illustrative embodiments, the drill rig substructure 511 may also include strut support shoes 525 to which the support struts 524 may be attached after erection of the drilling rig mast. Similar to the mast support shoes 523, the strut support shoes 525 may also be located on the drilling floor 512 and may include pin holes 545 corresponding to the respective pin holes 544 at the lower ends of the support struts 524. In yet other illustrative embodiments, the drilling rig substructure 511 may also include a mast raising apparatus 522, such as one or more hydraulic cylinders and the like, that may be used to erect the drilling rig mast after the support legs 521 have been pivotably attached to the mast support shoes 523, which will be described in detail below.

In some illustrative embodiments disclosed herein, the pin holes 541 of the support legs 521 may have a substantially circular shape, as may typically be used for a pinned structural connection that is designed to transfer a load from one structural component to another, while simultaneously allowing one of the members to be rotated freely about the pin that used to connect the two components. Accordingly, the pin holes 541 may be substantially the same shape and size as the removable pin 546 (see, FIGS. 5C-5F) that is used to attach the support legs 521 to the mast support shoes 523, giving due consideration to the clearances and tolerances that may be necessary for the requisite load transfer and joint rotation described above. On the other hand, the pin holes 543 of the mast support shoes 523 may be oversized—i.e., larger than the pin holes 541—so as to address the pin hole alignment and pin fit-up issues previously described. The pin holes 543 may be substantially any size and shape, provided, however, they are larger than the pin holes 541, and are of such a size as to facilitate any anticipated alignment issues that might arise during the positioning of the bottom section 520. For example, in certain illustrative embodiments, the pin holes 543 may have a substantially non-circular shape, such as teardrop shape and the like, as shown in FIG. 5A, and as is also illustrated in further detail in FIGS. 6A-6E and described below. Accordingly, the substantially circular pin holes 541 may be more easily aligned with the oversized pin holes 543 prior to installation of the pin 546.

Figure 5B:
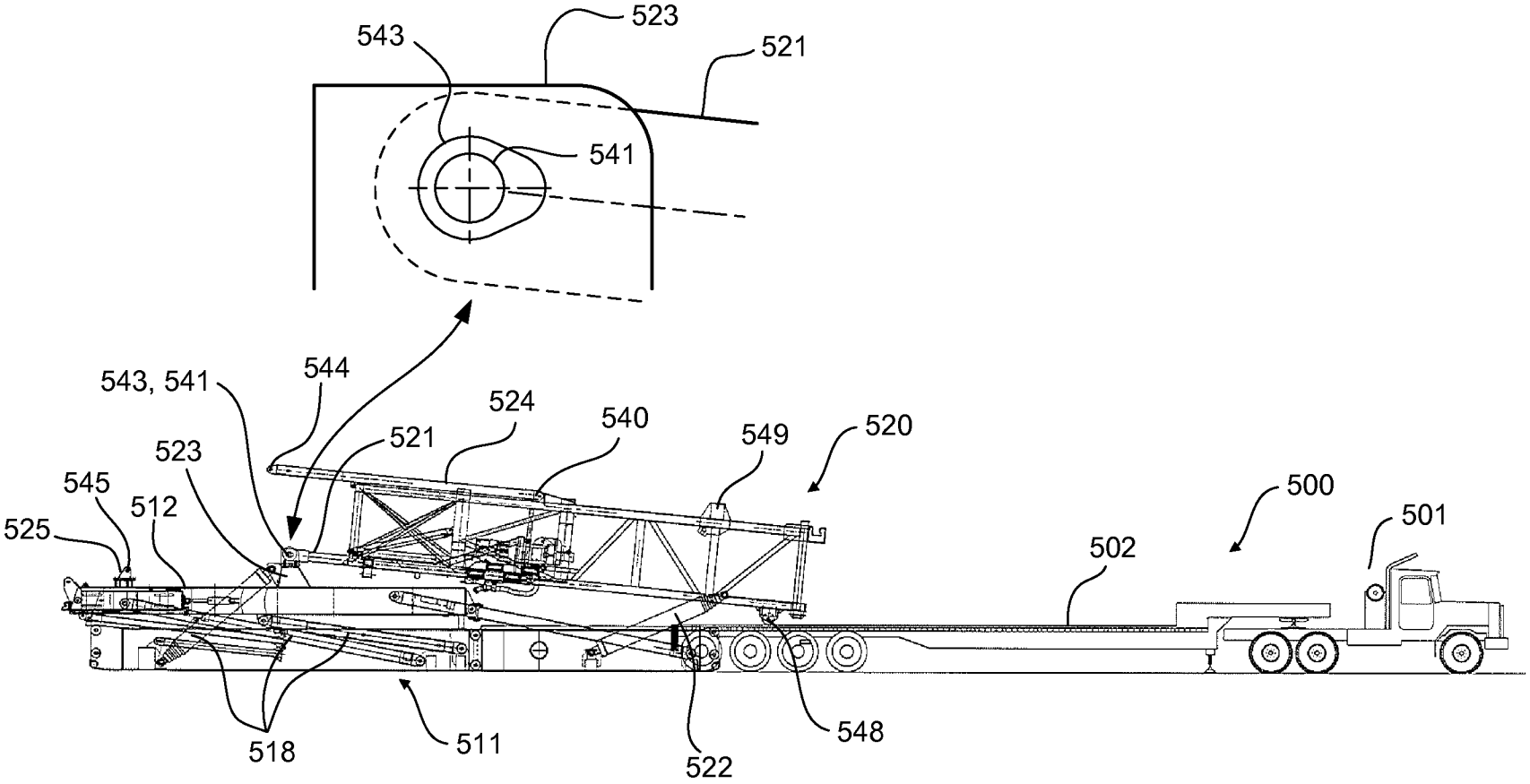
Figure 5C:
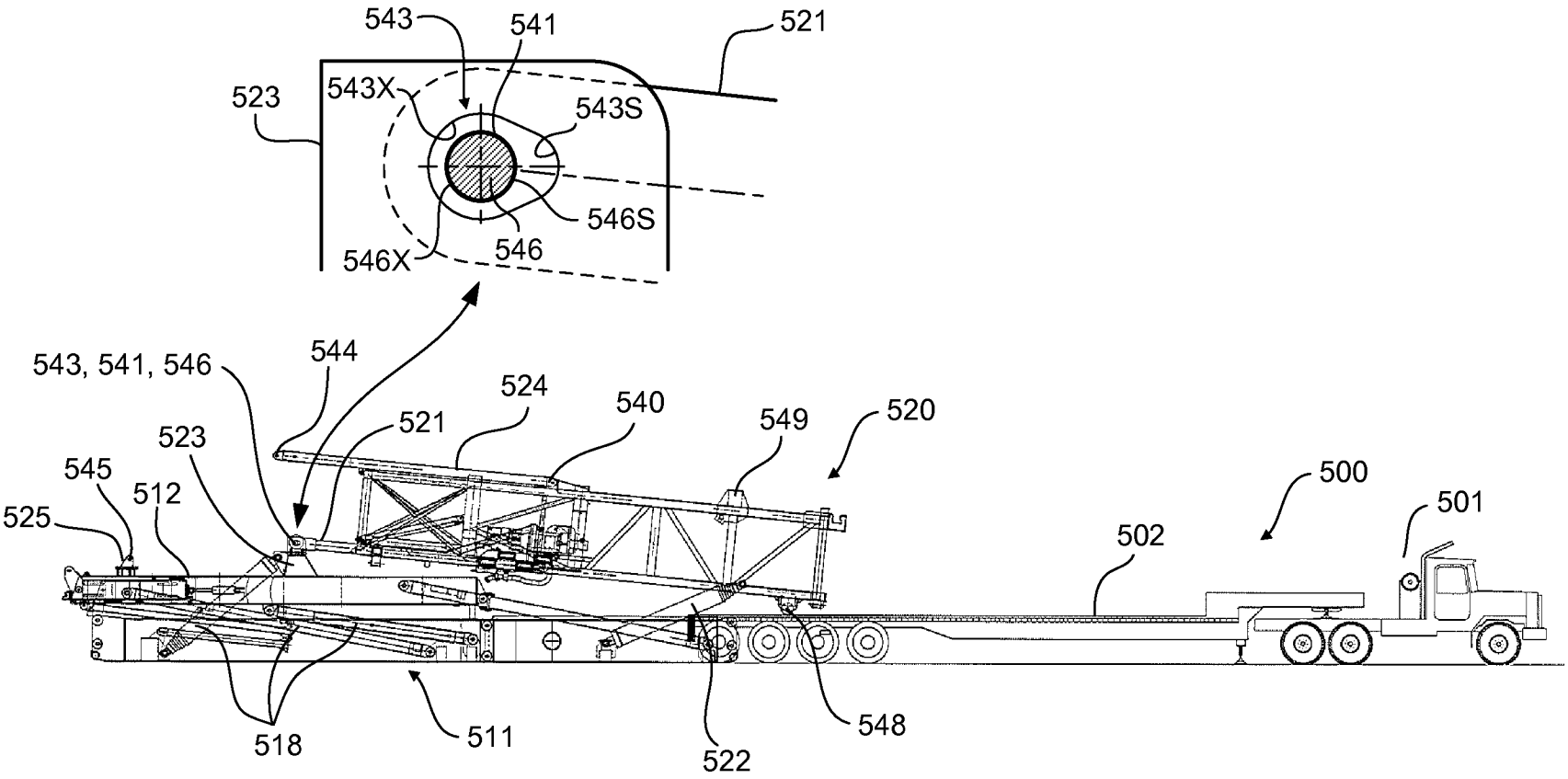

As shown in FIG. 5A, a truck 501 of the truck/trailer combination 500 may position the trailer 502 in an open area of the drilling rig substructure 511 and drilling floor 512, such as the open area A illustrated in FIG. 1B and described above. In certain embodiments, the bottom section 520 of the drilling rig mast may be moved rearwardly and inside of the open area (see, open area A of FIG. 1B) of the drilling floor 512 on rollers 548, so that the lower ends of the support legs 521 may be positioned proximate the mast support shoes 523. Thereafter, the lower end of the bottom section 520 may be raised by a movable raising device (not shown), such as a rolling hydraulic jack and the like, and the position of the bottom section 520 may be adjusted relative to the drilling floor 512 until the pin holes 541 of the support legs 521 are substantially aligned with oversized pin holes 543 of the mast support shoes 523, as shown in FIG. 5B. After the pin holes 543 and 541 are substantially aligned, a removable pin 546 having a substantially circular cross section may then be inserted into the aligned pin holes, as shown in FIG. 5C. In some illustrative embodiments, the removable pin 546 may have substantially the same size and shape as the pin holes 541, considering, of course, the clearances and tolerances that may be required to obtain a rotatably pinned structural connection, as described above. Furthermore, in this configuration the removable pin 546 may be substantially supported by the substantially circular pin holes 541 of the support legs 521, and may not yet be in contact with any of the surfaces of the oversized pin holes 543 of the mast shoe supports 523.

Figure 5D:
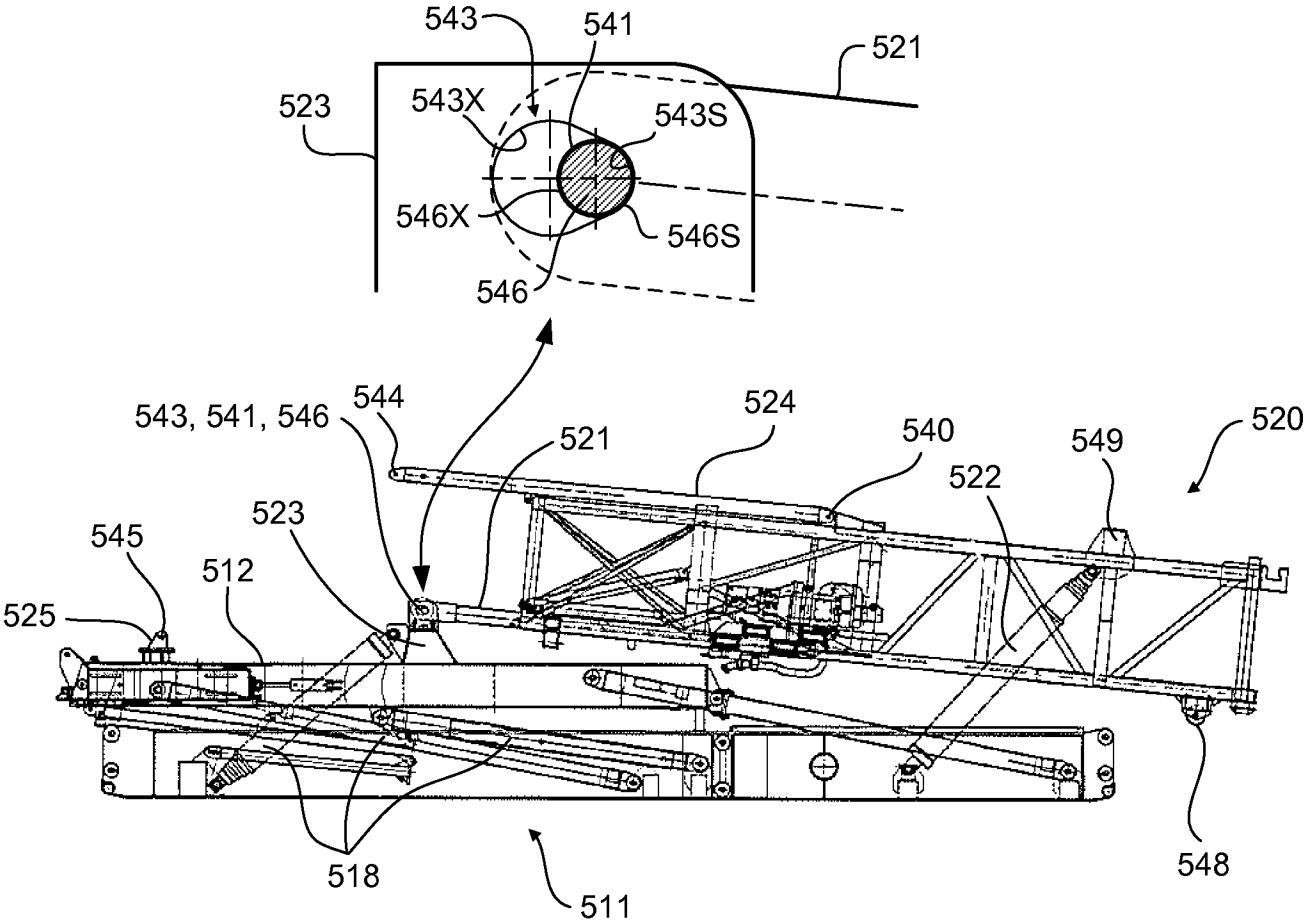

FIG. 5D illustrates the drilling rig system of FIGS. 5A-5C in a further advanced assembly stage. As shown in FIG. 5D, in some illustrative embodiments, the mast raising apparatus 522, such as a hydraulic cylinder and the like, may be pivotably attached to an erection lug 549 on the bottom section 520 of the drilling rig mast. Thereafter, the mast raising apparatus 522 may be extended so as to move the bottom section 520 relative to the drilling rig substructure 511. Accordingly, the support legs 521 and the pin 546 inserted into the pin holes 541 thereof will also be moved relative to the mast support shoes 523 until at least a first pin surface portion 546S of the pin 546 is adjacent to, or even in contact with, at least a first hole portion 543S of the oversized pin holes 543. Preferably, the size and shape of the first hole portion 543S that is adjacent to and/or in contact with the pin 546 is adapted to rotatably cooperate with the first pin surface portion 546S. In this way, when the pinned connection 550 (see, FIGS. 5E-5F) has been fully assembled as described below, the removable pin 546 may be able to transfer loads between the support leg 521 and the mast support shoe 523, as well as facilitate the pivotable rotation of the support leg 521 during the erection of the drilling rig mast, as previously described.

For example, in some embodiments of the illustrative oversized pin hole 543 having a teardrop-like shape as shown in FIGS. 5A-5F, the pin 546 may be moved adjacent to and/or in contact with the first hole portion 543S at the smaller end 543E of the teardrop shaped pin hole 543. Furthermore, the first hole portion 543S may have a substantially circular shape that is substantially the same size and shape as the first pin surface portion 546S of the pin 546 that is adjacent thereto. Moreover, in certain illustrative embodiments, the first hole portion 543S of the oversized pin hole 543 may be provided with similar clearances and tolerances with respect to the removable pin 546 as may be used for the substantially circular pin holes 541, thereby enabling the requisite load transfer and pivotable rotation previously described.

Additionally, in some illustrative embodiments, the mast raising apparatus 522 may also lift, or take the dead load of, the upper end of the bottom section 520 of the drilling rig mast such that the rollers 548 are no supported by trailer 502 of the truck/trailer combination 500. Thereafter, the truck 501 may move the trailer 502 from the open area (see, e.g., open area A of FIG. 1B) of the drilling rig substructure 511 and the drilling floor 512, thereby facilitating further drilling rig mast erection activities.

Figure 5E:
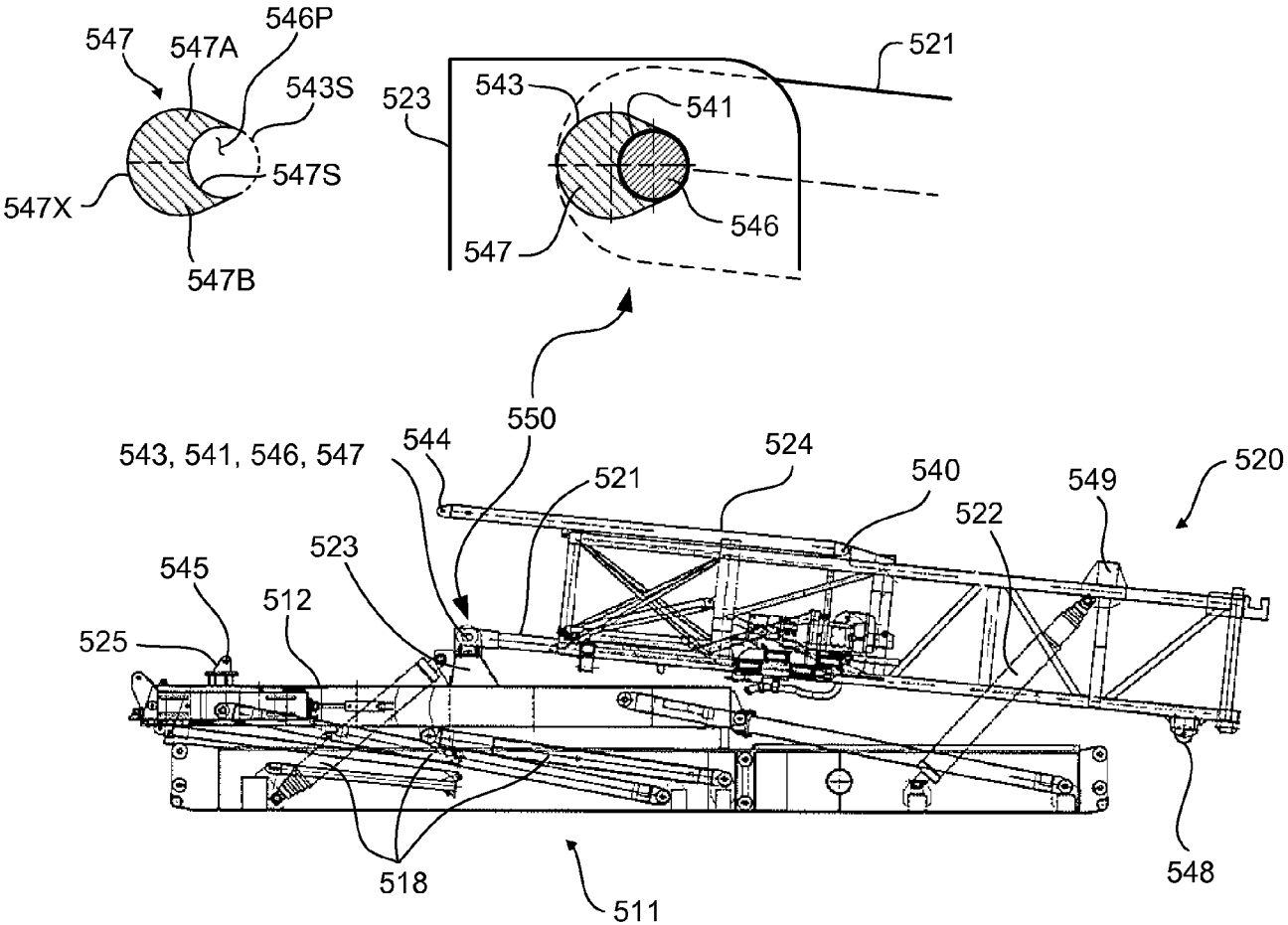

FIG. 5E illustrates the drilling rig system of FIGS. 5A-5D in yet a further advanced assembly stage. As shown in FIG. 5E, after the mast raising apparatus 522 has been actuated and the first pin surface portion 546S of the pin 546 has been moved adjacent to and/or into contact with the first hole portion 543S at the small end 543E of the oversized pin holes 543, a removable plug 547 may be inserted into the pin holes 543 proximate the pin 546 so as to maintain the pin 546 in this position. In certain illustrative embodiments of the present disclosure, the removable plug 547 may be shaped so that a first plug surface portion 547S of the plug 547 has a substantially circular shape that may be substantially the same size and shape as a second pin surface portion 546X of the pin 546 that is immediately adjacent thereto. Furthermore, in some embodiments, a combined shape that is defined by the first hole portion 543S (shown as a dotted line in FIG. 5E) of the oversized pin hole 543 and the first plug surface portion 547S of the removable plug 547 may define a substantially circularly shaped pin hole opening 246P, wherein the pin 546 will be "captured", or maintained in place, after the plug 547 has been inserted into the hole 543. Moreover, in certain embodiments, the pin hole opening 246P may be substantially the same size and shape as the substantially circular pin holes 541 of the support legs 521, as will be described in further detail with respect to FIGS. 6A-6E below.

In certain illustrative embodiments, the removable plug 547 may be made up of two or more separate plug parts, such as plug parts 547A and 547B (as indicated by a dotted line in FIG. 5E), which may facilitate easier plug installation and/or removal. Furthermore, in at least some embodiments, the removable plug 547 may be shaped so as to fittingly—i.e., non-rotatably—engage a second hole portion 543X of the oversized pin holes 543 (see, FIG. 5D). Moreover, the removable plug 547 may be sized and shaped so as to substantially fill a remaining portion of the oversized pin holes 543, as shown in FIG. 5E. For example, the removable plug 547 may have a second plug surface portion 547X that may be in substantially continuous contact with the second hole portion 543X. In this way, the fully assembled pinned connection 550—which includes both the removable pin 546 and the removable plug 547—may be capable of transferring loads from, and facilitating the pivotable rotation of, the support legs 521 of the drilling rig mast bottom section 520. In other embodiments, the removable plug 547 may be shaped so as to only partially fill the remaining portion of the oversized pin holes 543, such that the second plug surface portion 547X is only in partial contact with the second hole portion 543X, and which may also enable easier installation and/or removal of the plug 547, as illustrated in FIGS. 7D-7E and FIGS. 8D-8E and described below. It should be noted, however, that the final configuration of the removable plug 547—e.g., multiple plug parts, substantially or partially filling the oversized pin hole 543, etc.—may be as necessitated by the anticipated loads that may be imparted on the pinned connection 550 during assembly, erection, disassembly, and/or operation of the drilling rig.

It may be appreciated by those having skill in the art that, depending on the overall pin alignment and mast erection requirements, the relative arrangement of the substantially circular pin hole and the oversized pin hole of the present disclosure may be reversed. For example, in certain illustrative embodiments, the pin holes 543 of the mast support shoes 523 may have a substantially circular shape, and furthermore, may be substantially the same size as the removable pin 546. Moreover, in other embodiments, the pin hole 541 of the support legs 521 may be an oversized pin hole, and may also have a substantially non-circular shape as previously described. Additionally, the when the pin hole 541 is an oversized pin hole, the removable plug may be adapted to be inserted in the pin hole 541, also as previously described.

In some illustrative embodiments of the present disclosure, additional sections of the drilling rig mast may be assembled to the bottom section 520 after the pinned connection 550 has been fully assembled—that is, after the removable pin and plug 546, 547 have been installed—and prior to mast erection. For example, additional mast sections, such as the mid-sections 30 or 130 illustrated in FIGS. 1F-1H, FIGS. 1M-1P, and FIGS. 2, 3 and 4A-4H, may be assembled as described in the associated disclosure set forth above.

Figure 5F:
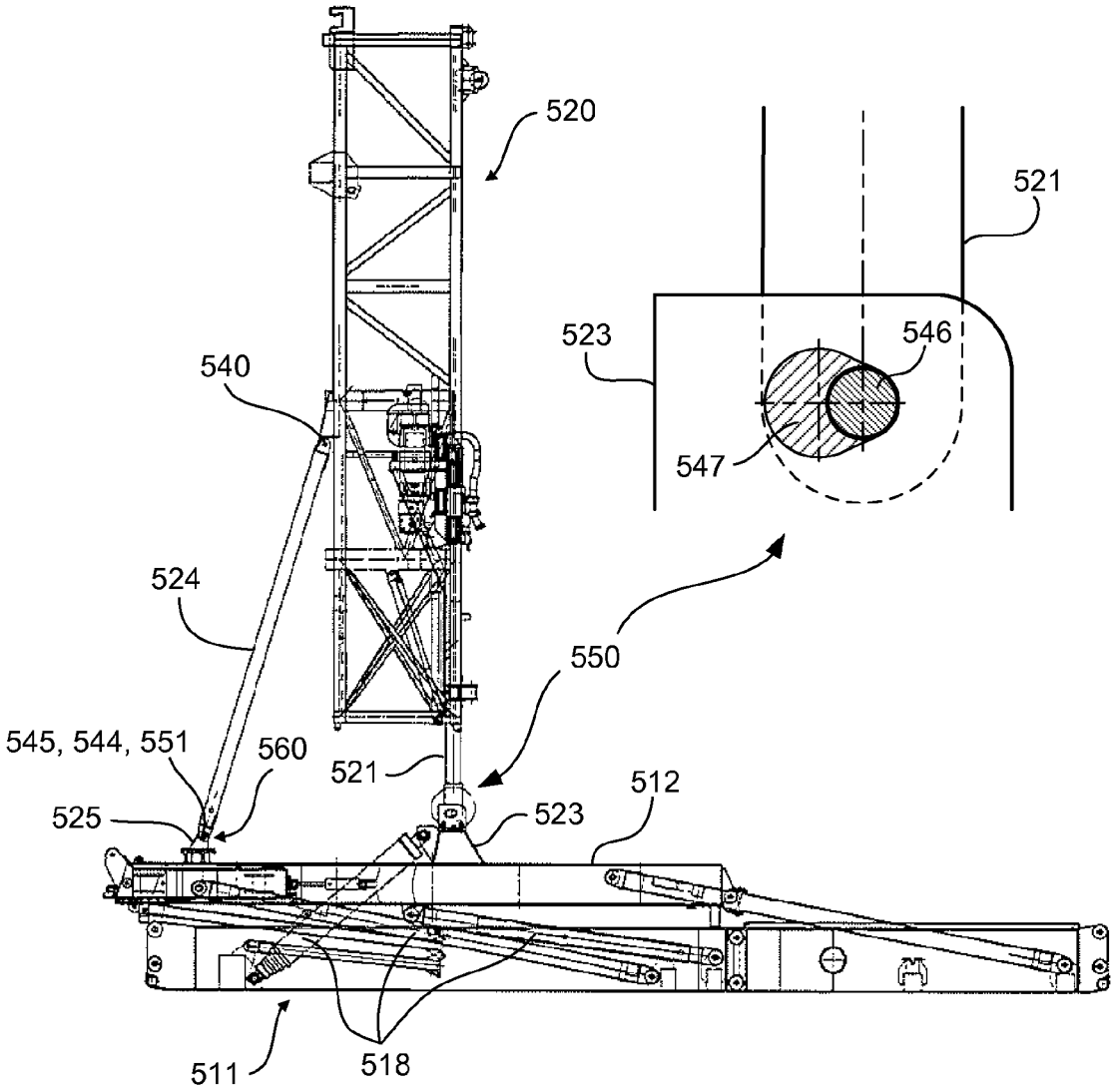
FIG. 5F is an elevation view of the drilling rig system of FIGS. 5A-5E after erection of the rig mast to a substantially vertical operating orientation using an illustrative pinned structural connection disclosed herein.

FIG. 5F illustrates the drilling rig assembly of FIGS. 5A-5E after the drilling rig mast has been erected. As shown in FIG. 5F, the drilling rig mast may be rotated by the mast erection apparatus 522 (see, FIGS. 5A-5E) about the pinned connection 550 during the erection process so that the support legs 521 are moved from a substantially horizontal orientation to a substantial vertical orientation. Additionally, in some embodiments, the support struts 524 may be pivoted about the pinned connections 540 until the pin holes 544 of the support struts 524 are aligned with pin holes 545 of the strut support shoes 525. Thereafter, a removable pin 551 may be inserted through the aligned pin holes 544, 545 so as to create a pinned connection 560 that attaches the support struts 524 to the strut support shoes 525 of the drilling rig substructure 511.

It should be noted that when the alignment of the pin holes 544 with the pin holes 545 may be problematic—e.g., similar to the situation described with respect to the pin holes 541 and 543 above—the pinned connection 560 may be modified so as to utilize an oversized pin hole on either the support struts 524 or the struts support shoes 525. Furthermore, a pin and plug arrangement similar to the pin 546 and plug 547 arrangement described with respect to the pinned connection 550 above may also be employed, although the specific details may be modified as may be appropriate for the pinned connection 560, such as one of the arrangement described below and illustrated in FIGS. 6A-6D. Furthermore, it should also be noted that the pinned structural connections utilizing the pin and plug arrangements described herein may generally be adapted to be used in any instances where the alignment between respective pin holes may be difficult, and should not be restricted only to those applications specifically dealing with drilling rigs, drilling rig mast structures, and/or the erection thereof.

Figure 6A:
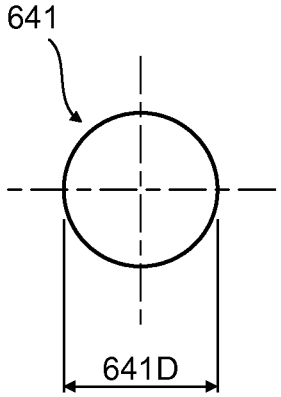
FIGS. 6A-6E schematically illustrate one embodiment of a pin and plug arrangement of an illustrative pinned structural connection of the present disclosure.

FIGS. 6A-6E schematically depict one illustrative embodiment of a pin and plug arrangement that may be used to create a novel pinned structural connection in accordance with the present disclosure. FIG. 6A shows a view of a first pin hole 641, which may be representative of any illustrative pin hole in any illustrative structural component that, when used in conjunction with an appropriately designed and sized pin, may be used to facilitate the attachment of one structural component to another. For example, the first pin hole 641 may be representative of and/or similar to the pin holes 541 in the lower end of the support legs 521 of the bottom mast section 520 illustrated in FIGS. 5A-5F and described above. Furthermore, the first pin hole 641 may be a substantially circular pin hole having a size or diameter 641D.

Figure 6B:
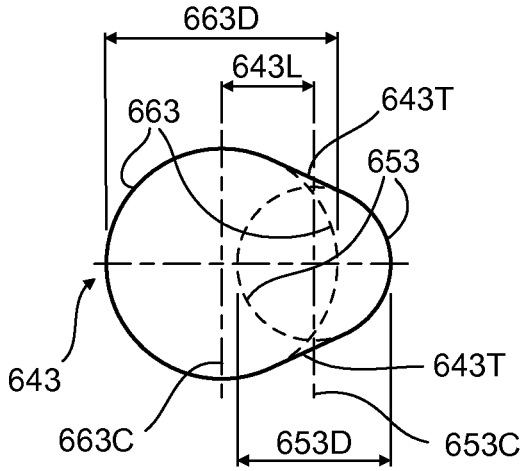

FIG. 6B shows a view of an oversized pin hole 643 of a second structural component, which may have a substantially non-circular shape, and, in accordance with some illustrative embodiments of the present disclosure, may facilitate an easier alignment of a pinned structural connection as previously described. As illustrated in FIG. 6B, the oversized pin hole 643 may have a substantially teardrop-like shape, and which may be similar in some respects to the oversized pin holes 543 of the mast support shoes 523 illustrated in FIGS. 5A-5F and described above. It should be appreciated, however, that other shapes may also be used for the oversized pin holes 643, as will be further described with respect to FIGS. 7A-7E and FIGS. 8A-8E below. In some embodiments, the teardrop-shaped oversized pin hole 643 shown in FIG. 6B may generally be defined by a shape comprising two overlapping substantially circular shapes 653 and 663, which may be joined by common tangent lines 643T therebetween. The first substantially circular shape 653 may be adapted to rotatably cooperate with a pin 646 (see, FIG. 6C), and as such may have a size or diameter 653D, that, in certain illustrative embodiments, may be substantially the same as the diameter 641D of the first pin hole 641. Accordingly, when a corresponding pinned connection is fully assembled, loads may be properly transferred and substantially free rotation may be permitted about the pin, as previously described.

The second substantially circular shape 663 may have a size or diameter 663D that is larger than the diameter 653D of the first substantially circular shape 653, thereby facilitating easier pin hole alignment and pin installation, as noted above. In certain embodiments, the diameter 663D may range anywhere from 25-50% larger than the diameter 653D, whereas in other embodiments, the size difference between the diameters 653D and 663D may be less than 25% or greater than 50%, depending on the fit-up and alignment criteria of the first pin hole 641 and the oversized non-circular pin hole 643. Furthermore, in some illustrative embodiments, a centerline 653C of the first substantially circular shape 653 may be offset from a centerline 663C of the second substantially circular shape 663 by a distance 643L, which may also provide additional space and/or clearance for pin hole alignment and pin installation.

Figure 6C:
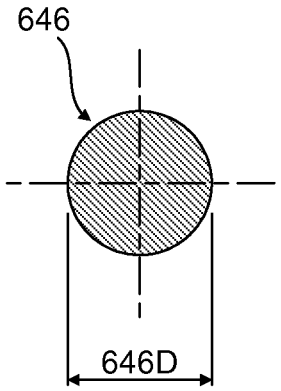

FIG. 6C shows a cross-sectional view of a removable pin 646 having a substantially circular shape that may be used in conjunction with some illustrative embodiments of the pinned structural connections of the present disclosure. The pin 646 may have a size or diameter 646D that is substantially the same as the diameter 641D of the first pin hole 641, giving due consideration for the requisite gap 646G (see, FIG. 6E) that may be necessary to facilitate the free rotation of the assembled pinned connection, as previously discussed, while still enabling the proper transfer of loads from one structural component to another.

Figure 6D:
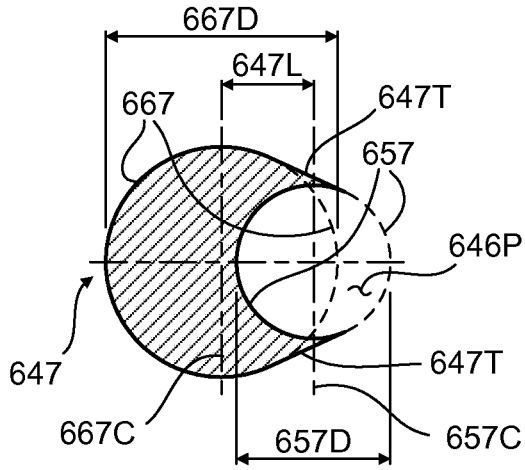

FIG. 6D illustrates one embodiment of a removable plug 647 of the present disclosure that may be adapted to maintain the position of the removable pin 646 within the oversized non-circular pin hole 643, thereby facilitating load transfer and pivotable rotation between structural components, as previously discussed. Furthermore, in some illustrative embodiments, the removable plug 647 may be shaped such that the plug 647 substantially fills a remaining portion of the oversized non-circular pin hole 643 that is not occupied by the removable pin 646, while simultaneously maintaining the position of the pin 646. As such, the removable plug 647 may have a shape that is, in at least some respects, substantially the same as the shape of the oversized non-circular pin hole 643. For example, similar to the pin hole 643, the plug 647 may also be defined by a shape comprising two overlapping substantially circular shapes 657 and 667, as shown in FIG. 6D, which may be joined by common tangent lines 647T therebetween. However, rather than exactly mimicking the shape of the oversized non-circular pin hole 643, that part of the removable plug 647 that is defined by the first substantially circular shape 657 will not be present. Instead, the plug 647 will have a partial "hole" that is at least partially defined by the first substantially circular shape 657, the shape and size of which may be adapted so that the plug 647 may rotatably cooperate with the removable pin 646. Furthermore, in some illustrative embodiments, after the removable plug 647 has been inserted into the oversized hole 643, the plug 647 and the hole 643 will together define a second pin hole 646P, such as the pin hole 546P shown in FIG. 5E and described above. Accordingly, the first substantially circular shape 657 may have a size or diameter 657D that is substantially the same as the diameter 653D. Moreover, the second pin hole 646P will be occupied by the removable pin 646 when the pinned structural connection is fully assembled, as shown in FIG. 6E.

In order to ensure a proper fit between the removable plug 647 and the oversized non-circular pin hole 643, a centerline 667C of the second substantially circular shape 667 of the plug 647 should offset from a centerline 657C of the first substantially circular shape 657 by a distance 647L that is substantially the same as the distance 643L between the first and second centerlines 653C and 663C of the pin hole 643, as shown in FIG. 6B. Furthermore, the size and shape of the second substantially circular shape 667 should also be adapted such that the removable plug 647 non-rotatably engages the oversized pin hole 643 when the plug 647 is inserted into the pin hole 643 proximate the pin 646, as shown in FIG. 6E. As such, the size of diameter 667D of the second substantially circular shape 667 may be substantially the same as the diameter 663D, giving due consideration to any clearances and/or tolerances that may be required ensure that the installation and/or removal of the plug can readily be accomplished, while still facilitating the proper load transfer from one structural component to another.

Figure 6E:
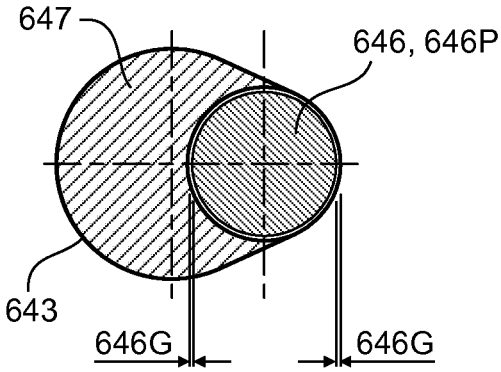

FIG. 6E illustrates the teardrop-shaped pin and plug arrangement of the present disclosure after both the removable pin 646 and the removable plug 647 have been installed into the oversized non-circular pin hole 643. As shown in FIG. 6E, in certain illustrative embodiments, a gap 646G may be present between the pin 646 and the pin hole 643 on one side, as well as between the pin 646 and the removable plug 647 on the opposite side thereof. The size of the gap 646G may typically be sized so as to provide the proper clearances and/or tolerances previously discussed, but has been exaggerated in FIG. 6E for illustrative purposes only.

Figure 7A:
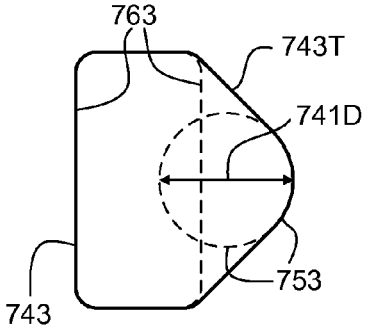
FIGS. 7A-7E schematically illustrate another embodiment of a pin and plug arrangement of an illustrative pinned structural connection disclosed herein.

FIGS. 7A-7E schematically depict additional illustrative embodiments of the pin and plug arrangement disclosed herein. As shown in FIG. 7A, an oversized, non-circular pin hole 743 of a first structural component may be defined by a shape that is a combination of a substantially circular shape 753 and a substantially rectangular shape 763, as well as tangent areas 743T therebetween. The substantially circular shape 753 may have a size or diameter 741D that is substantially the same as the size or diameter of a corresponding pin hole of a second structural component (not shown), as previously described with respect to FIGS. 6A-6E above.

Figure 7B:
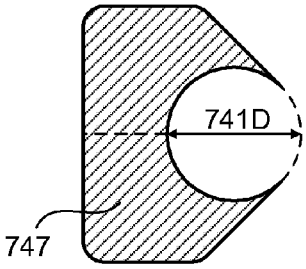
Figure 7C:
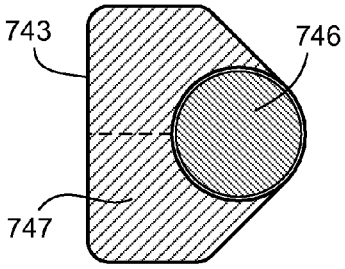
Figure 7D:
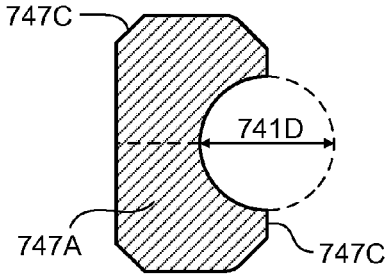
Figure 7E:
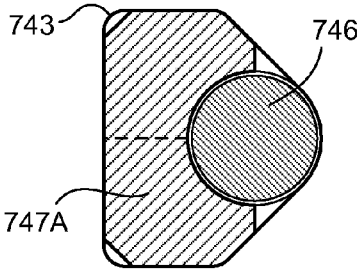

FIGS. 7B-7C show one illustrative embodiment where the removable plug 747 may substantially completely fill a remaining portion of the oversized non-circular pin hole 743 that is not occupied by the removable plug 746, whereas FIGS. 7D-7E illustrate an alternative embodiment where a removable plug 747A only partially fills the remaining portion of the oversized non-circular pinhole 743 while maintaining the position of the removable pin 746 as previously described. As shown in FIGS. 7D-7E, the alternative removable plug 747A may be designed such that some areas 747C of the plug 747A may be trimmed or chamfered for easier installation and/or removal, whereas the circular interface of the plug 747A against the pin 746 may have substantially the same size or diameter 741D as previously described. Moreover, either of the removable plugs 747, 747A may be made up of two or more plug parts (as indicated by dotted lines).

Figure 8A:
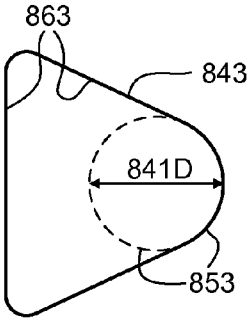
FIGS. 8A-8E schematically illustrate a further illustrative pin and plug arrangement of the present disclosure.
Figure 8B:
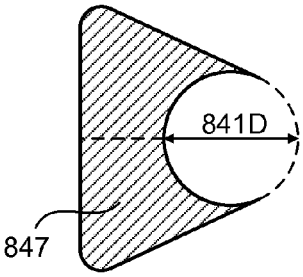
Figure 8C:
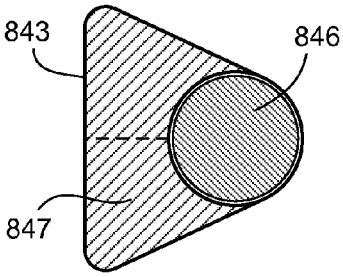
Figure 8D:
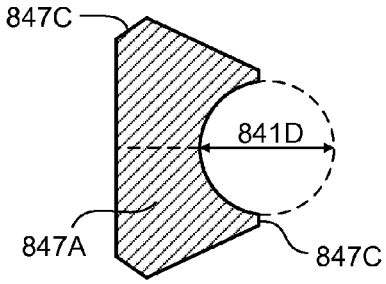
Figure 8E:
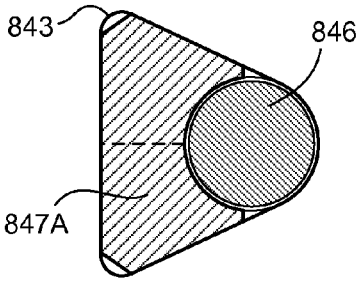

FIGS. 8A-8C schematically depict yet another illustrative embodiment of the pin and plug arrangement of the present disclosure, where an oversized non-circular opening 843 and a removable plug 847 are based on a shape that is substantially defined by a combination of a substantially circular shape 853 and a substantially triangular shape 863. Furthermore, FIGS. 8D-8E illustrate an alternative removable plug 847A where some areas 847C of the alternative plug 847A may be trimmed and/or chamfered for easier installation and/or removal. As with the removable plugs 747 and 747A above, either of the removable plugs 847, 847A may be made up of two or more plug parts (as indicated by dotted lines). It should be appreciated that other shape combinations may also be used to define the shape of an oversized non-circular pin hole and removable plug of the present disclosure, while still being within the spirit and teachings of the present disclosure.

The present invention, therefore, provides in some, but not in necessarily all, embodiments a method for connection two parts of a mast of a drilling rig, the method including: connecting a bottom mast section to a support, the bottom mast section having bottom connection apparatus; moving a second mast section adjacent the bottom mast section, the second mast section releasably connected to a vehicle and said moving done by moving said vehicle, the second mast section having second connection apparatus; and moving the bottom mast section so that the bottom connection apparatus contacts the second connection apparatus and engages the second connection apparatus to secure the bottom mast section to the second mast section. Such a method may one or some, in any possible combination, of the following: releasing the second mast section from the vehicle, and moving the vehicle away from the second mast section; raising with mast raising apparatus the mast comprising the bottom mast section secured to the second mast section; wherein the support is a substructure with raising apparatus, the method further including: raising the substructure with the raising apparatus to move the bottom mast section with respect to the second mast section to facilitate engagement of the bottom connection apparatus with the second connection apparatus; locking together the bottom connection apparatus and the second connection apparatus; the bottom mast section comprises a jaw member connected to the bottom mast section with a throat and a slot, the second connection apparatus comprises an insertion member with a bar, the insertion member sized and located for receipt of an end thereof in the throat of the jaw member and the bar sized and located for receipt within the slot, the method further including moving the bottom mast section to move the end of the insertion member into the throat and to move the bar into the slot; the jaw member has two spaced-apart plates each with a flared portion and a throat defined between the flared portions, the method further including moving an end of the insertion member into the throat; the bottom mast section is two legs each with a jaw member connected thereto, each with a throat and a slot, the second connection apparatus comprises an insertion member with a bar, the insertion member sized and located for receipt of an end thereof in the throat of the jaw member and the bar sized and located for receipt within the slot, the method further including moving the bottom mast section to move the ends of the insertion members into the throats and to move the bars into the slots; the jaw member has two spaced-apart plates each with a flared portion and a throat defined between the flared portions, the method further including moving an end of the insertion member into the throat; wherein the bottom mast section has a primary connection member connected thereto and spaced-apart from the jaw member, the second mast section has a secondary connection member connected thereto, the method further including securing the secondary connection member to the primary connection member; the primary connection member has two spaced-apart plates each with an outwardly flared portion and includes a throat between the outwardly flared portions of the two spaced-apart plates for facilitating entry of part of the secondary connection apparatus between the two spaced-apart plates; the bottom mast section has two legs each with a primary connection member connected thereto and spaced-apart from a jaw member, the second mast section has two legs each with a secondary connection member connected thereto, the method further including securing the secondary connection members to the primary connection members; the primary connection members each have two spaced-apart plates each with an outwardly flared portion and include a throat between the outwardly flared portions of the two spaced-apart plates for facilitating entry of part of the secondary connection apparatuses between the two spaced-apart plates; and/or wherein the support is a substructure with raising apparatus, the method further including raising the substructure with the raising apparatus to move the bottom mast section with respect to the second mast section to engage the bottom connection apparatus with the secondary connection apparatus, and said raising aligning the bottom mast section with the second mast section as the substructure is raised.

The present invention, therefore, provides in some, but not in necessarily all, embodiments a mast system for rig operations, the mast system including: a support, a bottom mast section connected to the support; the bottom mast section having bottom connection apparatus; a second mast section adjacent and connectible to the bottom mast section, the second mast section releasably connected to a vehicle for moving the second mast section; the second mast section having second connection apparatus; and the bottom mast section movable on the support so that the bottom connection apparatus can contact the second connection apparatus and engage the second connection apparatus to secure the bottom mast section to the second mast section. Such a mast system may one or some, in any possible combination, of the following: wherein the support is a substructure with raising apparatus, the substructure with the raising apparatus able to raise the bottom mast section with respect to the second mast section prior to facilitate engagement of the bottom connection apparatus with the second connection apparatus; locking apparatus for locking together the bottom connection apparatus and the second connection apparatus; the bottom mast section having a jaw member connected to the bottom mast section, the jaw member having a throat and a slot, the second connection apparatus comprising an insertion member with a bar, the insertion member sized and located for receipt of an end thereof in the throat of the jaw member and the bar sized and located for receipt within the slot, and the bottom mast section movable to move the end of the insertion member into the throat and to move the bar into the slot; the jaw member has two spaced-apart plates each with a flared portion and a throat defined between the flared portions, the throat for receipt therein of an end of the insertion member into the throat; the bottom mast section having two legs each with a jaw member connected to a leg and each with a throat and a slot, the second mast section having two legs each with a second connection apparatus comprising an insertion member with a bar, the insertion member sized and located for receipt of an end thereof in the throat of a jaw member and the bar sized and located for receipt within a slot of the jaw member, and the bottom mast section movable to move the ends of the insertion members into the throats and to move the bars into the slots; the bottom mast section having a primary connection member connected thereto and spaced-apart from the jaw member, the second mast section having a secondary connection member connected thereto, and the secondary connection member securable to the primary connection member; and/or the bottom mast section has two legs each with a primary connection member connected thereto and spaced-apart from a jaw member, the second mast section has two legs each with a secondary connection member connected thereto, and each secondary connection member securable to an adjacent primary connection member; the primary connection member has two spaced-apart plates each flared out and including a throat defined between the two spaced-apart plates for facilitating entry of part of the second connection apparatus between the two spaced-apart plates.

The systems and methods of the inventions described in the following pending U.S. patent applications, co-owned with the present invention, filed on even date herewith, naming Donnally et al as inventors, fully incorporated herein for all purposes, may be used with certain embodiments of the present invention, the applications entitled: "Drilling Rig Structure Installation And Methods"; "Drilling Rig Drawworks Installation"; and "Drilling Rigs And Erection Methods".

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A system, comprising:

a drilling rig mast comprising at least one support leg;

a drilling rig mast support comprising at least one mast support shoe; and a pinned connection between said at least one support leg and said at least one mast support shoe, said pinned connection comprising:

a pin;

an oversized hole comprising at least a first hole portion; and a removable plug that is adapted to be inserted into said oversized hole, wherein said removable plug comprises at least a first plug surface portion, and wherein said first hole portion and said first plug surface portion define at least part of a pin hole that is adapted to receive said pin.

2. The system of claim 1, wherein said pin has a substantially circular cross section and said pin hole has a substantially circular shape.

3. The system of claim 2, wherein said pinned connection further comprises an additional pin hole that is adapted to receive said pin, said additional pin hole having a substantially circular shape and a size that is substantially the same as a size of said pin hole.

4. The system of claim 1, wherein said pin is adapted to be inserted into said oversized hole and positioned adjacent to said first hole portion.

5. The system of claim 4, wherein said removable plug is further adapted to maintain said position of said pin adjacent to said first hole portion.

6. The system of claim 4, wherein said removable plug is further adapted to substantially fill a remaining portion of said oversized hole after said pin has been positioned adjacent to said first hole portion.

7. The system of claim 4, wherein said pin is operatively coupled to said at least one support leg, and wherein said system further comprises a positioning apparatus that is adapted to move said at least one support leg so as to position said pin adjacent to said first hole portion.

8. The system of claim 7, wherein said positioning apparatus comprises an erection apparatus that is adapted to be pivotably attached to said drilling rig mast and is further adapted to raise said drilling rig mast into a substantially vertical operating orientation.

9. The system of claim 1, wherein said pinned connection is adapted to pivotably attach said at least one support leg to said at least one mast support shoe.

10. The system of claim 9, wherein said first hole portion and said first plug surface portion are adapted to rotatably cooperate with a surface of said pin.

11. The system of claim 1, wherein said removable plug comprises a second plug surface portion, said oversized hole comprises a second hole portion, and said second plug surface portion is adapted to non-rotatably engage at least a part of said second hole portion.

12. The system of claim 1, wherein said oversized hole has a teardrop shape comprising a first end and a second end, wherein said first hole portion is disposed at said first end and has a substantially circular shape of a first size, wherein said oversized hole further comprises a second hole portion that is disposed at said second end, and wherein said second hole portion has a substantially circular shape of a second size that is larger than said first size.

13. The system of claim 1, wherein said oversized hole is located on said at least one mast support shoe.

14. The system of claim 1, wherein said oversized hole is located on said at least one support leg.

15. The system of claim 1, wherein said removable plug comprises a plurality of plug parts.

16. A system, comprising:

a drilling rig mast comprising at least one mast section, wherein said at least one mast section comprises at least one support leg, and said at least one support leg comprises a first pin hole having a substantially circular shape;

a drilling rig mast support comprising at least one mast support shoe, wherein said at least one mast support shoe comprises an oversized hole, and said oversized hole comprises at least a first hole portion having a substantially circular shape;

a pin that is adapted to pivotably attach said at least one support leg to said at least one support shoe, wherein said pin has a substantially circular cross section and is adapted to be inserted into said first pin hole and said oversized hole, and wherein said pin and is further adapted to be positioned adjacent to said first hole portion; and a removable plug that is adapted to be inserted into said oversized hole and is further adapted to maintain said position of said pin adjacent to said first hole portion, wherein said removable plug comprises at least a first plug surface portion that is adapted to be positioned adjacent to said pin, wherein said first hole portion and said first plug surface portion define at least part of a second pin hole having a substantially circular shape, and wherein said second pin hole is adapted to receive said pin.

17. The system of claim 16, further comprising an erection apparatus, wherein said erection apparatus is adapted to be pivotably attached to said drilling rig mast, to move said drilling rig mast so as to position said pin adjacent to said first hole portion, and to raise said drilling rig mast into a substantially vertical operating orientation.

18. The system of claim 16, wherein a size of said first pin hole is substantially the same as a size of said second pin hole.

19. The system of claim 16, wherein said first hole portion and said first plug surface portion are adapted to rotatably cooperate with a surface of said pin.

20. The system of claim 16, wherein said removable plug comprises a second plug surface portion, said oversized hole comprises a second hole portion, and said second plug surface portion is adapted to non-rotatably engage at least a part of said second hole portion.

21. A method, comprising:

positioning a support leg of at least one mast section of a drilling rig mast proximate a mast support shoe of a drilling rig support;

aligning a first substantially circular pin hole of said support leg with an oversized hole of said mast support shoe, wherein said oversized hole comprises at least a first hole portion having a substantially circular shape; and pivotably attaching said support leg to said mast support shoe by inserting a pin having a substantially circular cross section into said aligned holes, positioning said pin adjacent to said first hole portion, and inserting a removable plug into said oversized hole so as to substantially maintain said position of said pin adjacent to said first hole portion, wherein said removable plug comprises at least a first plug surface portion, and wherein said first hole portion and said first plug surface portion define a second substantially circular pin hole that is adapted to receive said pin.

22. The method of claim 21, wherein pivotably attaching said support leg to said mast support shoe comprises shaping said first hole portion and said first plug surface portion to rotatably cooperate with a surface of said pin.

23. The method of claim 21, wherein positioning said pin adjacent to said first hole portion comprises moving said support leg so as to move said pin into at least partial contact with said first hole portion.

24. The method of claim 23, wherein moving said support leg comprises moving said support leg with an erection apparatus that is adapted to erect said drilling rig mast into a substantially vertical operating orientation.

25. The method of claim 21, wherein substantially maintaining said position of said pin adjacent to said first hole portion comprises shaping said first hole portion and said first plug surface portion so that said second substantially circular pin hole is substantially the same size as said first substantially circular pin hole.

26. The method of claim 25, wherein substantially maintaining said position of said pin adjacent to said first hole portion further comprises shaping said oversized hole to have at least a second hole portion, and shaping said removable plug to have at least a second plug surface portion that non-rotatably engages at least part of said second hole portion.

27. The method of claim 21, further comprising, after pivotably attaching said support leg to said mast support shoe, erecting said drilling rig mast into a substantially vertical operating orientation by pivotably rotating said drilling rig mast about said pin.

* * * * *